US012501937B2

(12) United States Patent
Butin et al.

(10) Patent No.: US 12,501,937 B2
(45) Date of Patent: Dec. 23, 2025

(54) AEROSOL-GENERATING DEVICE WITH MEANS FOR DETECTING AT LEAST ONE OF THE INSERTION OR THE EXTRACTION OF AN AEROSOL-GENERATING ARTICLE INTO OR FROM THE DEVICE

(71) Applicant: Philip Morris Products S.A., Neuchatel (CH)

(72) Inventors: Yannick Butin, Neuchatel (CH); Jerome Christian Courbat, Neuchatel (CH); Oleg Fursa, Neuchatel (CH); Oleg Mironov, Neuchatel (CH); Enrico Stura, Neuchatel (CH); Valerio Oliana, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 407 days.

(21) Appl. No.: 17/637,269

(22) PCT Filed: May 27, 2020

(86) PCT No.: PCT/EP2020/064693
§ 371 (c)(1),
(2) Date: Feb. 22, 2022

(87) PCT Pub. No.: WO2021/037403
PCT Pub. Date: Mar. 4, 2021

(65) Prior Publication Data

US 2022/0369714 A1 Nov. 24, 2022

(30) Foreign Application Priority Data

Aug. 23, 2019 (EP) ..... 19193286

(51) Int. Cl.
*A24F 40/53* (2020.01)
*A24F 40/465* (2020.01)
*A24F 40/57* (2020.01)

(52) U.S. Cl.
CPC ..... *A24F 40/465* (2020.01); *A24F 40/53* (2020.01); *A24F 40/57* (2020.01)

(58) Field of Classification Search
None
See application file for complete search history.

(56) References Cited

U.S. PATENT DOCUMENTS 10,973,091 B2 * 4/2021 Son ..... F24C 7/083
2014/0345606 A1 11/2014 Talon
(Continued)

FOREIGN PATENT DOCUMENTS

CN 105595437 A 6/2016
CN 107105779 A 8/2017
(Continued)

OTHER PUBLICATIONS

International Search Report and Written Opinion issued on Sep. 14, 2020 in PCT/EP2020/064693 filed on May 27, 2020.
(Continued)

*Primary Examiner* — Philip Y Louie
*Assistant Examiner* — Jeffrey A. Buckman
(74) *Attorney, Agent, or Firm* — Oblon, McClelland, Maier & Neustadt, L.L.P.

(57) ABSTRACT

An aerosol-generating device to heat an aerosol-forming substrate configured to form an inhalable aerosol when heated, including: a cavity to removably receive an article including the substrate and an inductively heatable susceptor to heat the substrate; a DC power supply; an inductive heating arrangement connected to the power supply and to generate an alternating magnetic field within the cavity to
(Continued)

Figure 1:
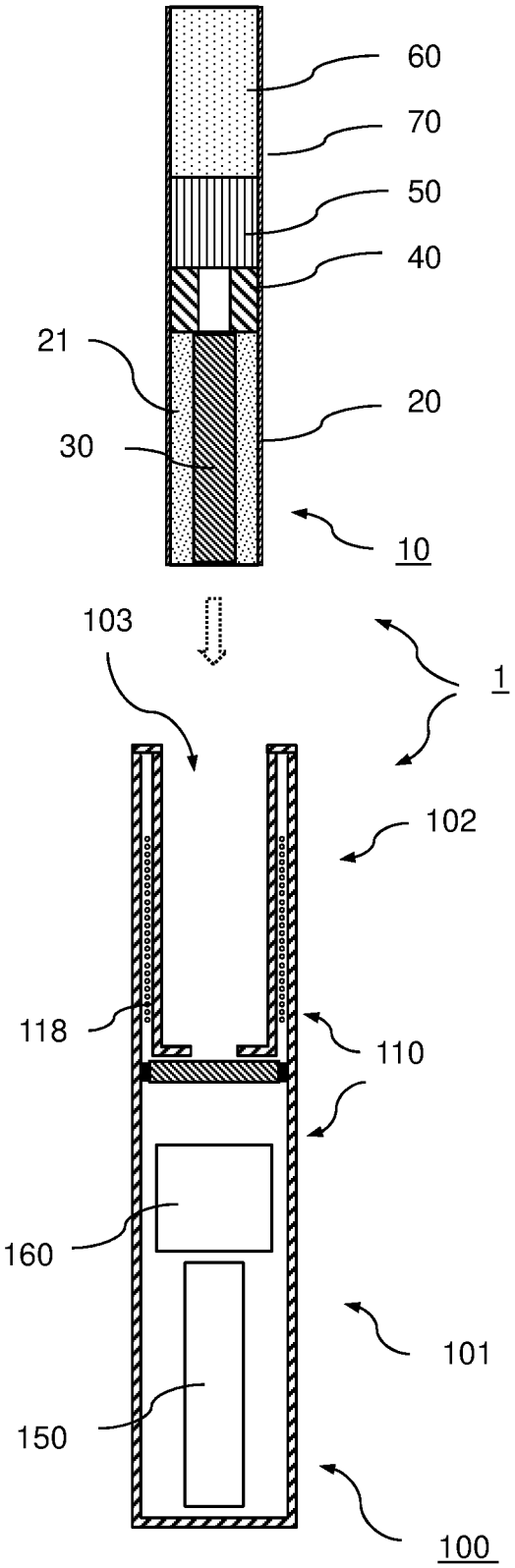

inductively heat the susceptor in a heating operation when the article is received in the cavity; and control circuitry to generate power pulses for intermittently powering on the arrangement, measure for each power pulse a property of the arrangement, detect whether a change of the property has occurred as compared previous power pulses due to the susceptor becoming present within or absent from the cavity when the article is inserted or extracted, and detect insertion or extraction of the article in response to detecting of a change of the property.

16 Claims, 4 Drawing Sheets

(56) References Cited

U.S. PATENT DOCUMENTS

| | | | | |
|---|---|---|---|---|
| 2016/0158782 | A1 | 6/2016 | Henry, Jr. et al. | |
| 2017/0166397 | A1 | 6/2017 | Sur et al. | |
| 2017/0259170 | A1 | 9/2017 | Bowen et al. | |
| 2017/0311648 | A1 | 11/2017 | Gill et al. | |
| 2018/0132529 | A1 | 5/2018 | Sur et al. | |
| 2018/0301915 | A1* | 10/2018 | Colotte | H05B 1/0244 |
| 2020/0093185 | A1* | 3/2020 | Lim | A24F 40/53 |

FOREIGN PATENT DOCUMENTS

| | | | |
|---|---|---|---|
| CN | 108289516 | A | 7/2018 |
| CN | 109890233 | A | 6/2019 |
| JP | 2017-501682 | A | 1/2017 |
| JP | 2017-515488 | A | 6/2017 |
| JP | 2017-533732 | A | 11/2017 |
| KR | 10-2000-0046282 | A | 7/2000 |
| KR | 10-2017-0007262 | A | 1/2017 |
| KR | 20180129637 | A | 12/2018 |
| KR | 10-2019-0014844 | A | 2/2019 |
| RU | 2 670 951 | C2 | 10/2018 |
| UA | 118867 | C2 | 3/2018 |
| UA | 127714 | C2 | 6/2018 |
| WO | WO 99/20940 | A1 | 4/1999 |
| WO | WO 2013/098396 | A2 | 7/2013 |
| WO | WO 2015/177257 | A1 | 11/2015 |
| WO | WO 2018/216961 | A1 | 11/2018 |
| WO | WO 2019/002613 | A1 | 1/2019 |
| WO | WO 2019/060305 | A1 | 3/2019 |
| WO | WO 2020/249661 | A1 | 12/2020 |

OTHER PUBLICATIONS

International Preliminary Report on Patentability and Written Opinion issued on Dec. 2, 2021 in PCT/EP2020/064693 filed on May 27, 2020.

Office Action issued Sep. 25, 2023. in corresponding Indonesian Patent Application No. P00202201317 (with English Translation), 6 pages.

Russian Search Report issued Oct. 2, 2023 in Russian Patent Application No. 2022107472/03 (with English Translation), 4 pages.

Japanese Office Action issued May 27, 2024 in Japanese Patent Application No. 2022-512428 (with unedited computer-generated English Translation), 7 pages.

Ukraine Office Action Dated Oct. 14, 2024 issued in corresponding Ukraine Patent Application No. a202200965, with English Translation.

Israeli Office Action Dated Dec. 17, 2024, issued in corresponding Israeli Patent Application No. 290777, filed on Feb. 21, 2022.

Korean Office Action dated Jul. 1, 2025, issued in Korean Patent Application No. 10-2022-7005419 (with English translation).

Filipino Office Action dated Apr. 4, 2025, issued in Filipino Patent Application No. 1/2022/550386.

Chinese Office Action dated Feb. 19, 2025, issued in Chinese Patent Application No. 202080058064.0 (with English translation).

Japanese Office Action dated Jun. 5, 2025, issued in Japanese Patent Application No. 2024-176013 (with English translation).

Chinese Office Action dated Aug. 3, 2025, issued in Chinese Patent Application No. 202080058064.0 (with English translation).

* cited by examiner

AEROSOL-GENERATING DEVICE WITH MEANS FOR DETECTING AT LEAST ONE OF THE INSERTION OR THE EXTRACTION OF AN AEROSOL-GENERATING ARTICLE INTO OR FROM THE DEVICE

The present invention relates to an aerosol-generating device comprising a cavity and means for detecting the insertion or the extraction of an aerosol-generating article into the cavity. The invention further relates to an aerosol-generating system comprising such a device as well as to a method for operating such a device.

Aerosol-generating devices used for generating an inhalable aerosol by heating an aerosol-forming substrate are generally known from prior art. Such devices typically comprise a cavity for removably receiving at least a portion of an aerosol-generating article that includes the aerosol-forming substrate to be heated. For heating the substrate, the devices may comprise an inductive heating arrangement powered by a battery and configured to generate an alternating magnetic field within the cavity for inductively heating a susceptor that—in use of the device—is in thermal proximity or direct physical contact with substrate. The susceptor may be an integral part of the aerosol-generating article. Such devices may further comprise means for detecting the insertion or the extraction of an aerosol-generating article into the receiving cavity in order to enable or disable the heating process. This kind of detection may be realized by separate sensor means which continuously monitor the presence or non-presence of the article in the cavity. However, separate sensor means typically require additional assembly space in the device. Moreover, a continuous operation of the sensor is energy-consuming and, thus, may significantly reduce the operation time of the device.

Therefore, it would be desirable to have an aerosol-generating device with the advantages of prior art solutions but without their limitations. In particular, it would be desirable to have an aerosol-generating device providing improved means for detecting the insertion or the extraction of an aerosol-generating article into the receiving cavity of the device.

According to one aspect of the invention there is provided an aerosol-generating device for heating an aerosol-forming substrate that is capable to form an inhalable aerosol when heated, the device comprising:

- a cavity for removably receiving at least a portion of an aerosol-generating article, the article including the aerosol-forming substrate and an inductively heatable susceptor for heating the substrate;
- a DC power supply;
- an inductive heating arrangement connected to the DC power supply and configured to generate an alternating magnetic field within the cavity for inductively heating the susceptor of the article in a heating operation when the article is received in the cavity;
- a control circuitry configured to provide power from the DC power supply to the heating arrangement for powering on the inductive heating arrangement and to detect a change of at least one property of the inductive heating arrangement due to the susceptor becoming present within or absent from within the cavity when an aerosol-generating article is inserted into or extracted from the cavity, and in response to detect at least one of the insertion of an article into the cavity or the extraction of an article from the cavity.

According to another aspect of the invention there is provided an aerosol-generating device for heating an aerosol-forming substrate that is capable to form an inhalable aerosol when heated, the device comprising:

- a cavity for removably receiving at least a portion of an aerosol-generating article, the article including the aerosol-forming substrate and an inductively heatable susceptor for heating the substrate;
- a DC power supply;
- an inductive heating arrangement connected to the DC power supply and configured to generate an alternating magnetic field within the cavity for inductively heating the susceptor of the article in a heating operation when the article is received in the cavity;
- a control circuitry configured to generate power pulses for intermittently powering on the inductive heating arrangement and to detect a change of at least one property of the inductive heating arrangement due to the susceptor becoming present within or absent from within the cavity when an aerosol-generating article is inserted into or extracted from the cavity, and in response to detect at least one of the insertion of an article into the cavity or the extraction of an article from the cavity.

According to the invention it has been found that the inductive heating arrangement may be used not only for heating the substrate, but also for detecting at least one of the insertion of an article into the cavity or the extraction of an article from the cavity. Thus, the inductive heating arrangement may be used for multiple purposes. Advantageously, this enables to avoid additional assembly space for separate sensor means.

Moreover, it has been found that operating the inductive heating arrangement in a pulsed mode for the purpose of article detection advantageously reduces the power consumption and, thus, increases the overall operation time of the device as compared to other solutions.

According to the present invention detection of article insertion or article extraction is based on the fact that insertion and extraction of the article into the cavity modifies at least one property, in particular at least one electrical and/or magnetic property of the inductive heating arrangement due to the due to the susceptor becoming present at or absent from the vicinity of the inductive heating arrangement. The change of the at least one property caused by the susceptor becoming present at or absent may be due to an interaction between the field of the inductive heating arrangement and the susceptor.

The at least one property of the inductive heating arrangement may be any property having an associated parameter which has a different value in the presence of the susceptor as compared to the value in the absence of the susceptor. For example, the at least one property may be current, voltage, resistance, frequency, phase shift, flux, and inductance of the inductive heating arrangement.

Preferably, the property is at least one of an equivalent resistance or an inductance of the inductive heating arrangement. As used herein, the term "equivalent resistance" refers to the real part of a complex impedance defined as the ratio of the AC voltage supplied to the inductive heating arrangement to the measured AC current. Accordingly, the "equivalent resistance" may also be denoted as the resistive load of the inductive heating arrangement. Likewise, as used herein, the term "inductance" refers to the imaginary part of a complex impedance defined as the ratio of the supplied AC voltage to the measured AC current. Inductance, generally speaking, includes the property of an electric circuit to be susceptible to exterior electromagnetic influences.

The change of at least one property of the inductive heating arrangement may be due to a specific magnetic permeability and/or a specific electrical resistivity of the susceptor. That is, the susceptor within the aerosol-generating article may include a material having a specific magnetic permeability and/or a specific electrical resistivity. Preferably, the susceptor comprises an electrically conductive material. For example, the susceptor may comprise a metallic material. The metallic material may be, for example, one of aluminum, nickel, iron, or alloys thereof, for example, carbon steel or ferritic stainless steel. Aluminum has an electrical resistivity of about 2.65×10E-08 Ohm-meter, measured at room temperature (20° C.), and a magnetic permeability of about 1.256×10E-06 Henry per meter. Likewise, ferritic stainless steel has an electrical resistivity of about 6.9×10E-07 Ohm-meter, measured at room temperature (20° C.), and a magnetic permeability in a range of 1.26×10E-03 Henry per meter to 2.26×10E-03 Henry per meter.

In general, the control circuitry may be configured to detect at least one of the insertion of an aerosol-generating article into the cavity in order to start heating operation, the extraction of an aerosol-generating article from the cavity after a heating operation in order to enable heating operation to be restarted, or the extraction of an aerosol-generating article from the cavity during heating operation in order to stop the heating operation. In the first and the second case, the aerosol-generating device is not in heating operation, but in a specific article detection mode, in particular in an article insertion detection mode or in an article extraction detection mode, respectively. In the third case, the aerosol-generating device is in heating operation, that is, in a heating mode. Nevertheless, in the heating mode, the control circuitry may be able to detect the extraction of an aerosol-generating article from the cavity by detecting a change of at least one property of the inductive heating arrangement due to the susceptor becoming absent from the cavity when the article is extracted from the cavity.

In the first and the second case, that is, when the device is in the article detection mode, in particular in the article insertion detection mode and in the article extraction detection mode, the power pulses generated by the control circuitry specifically aim at detecting the insertion or the extraction of an aerosol-generating article into or from the cavity. Therefore, the power pulses generated for article detection during the article detection mode, in particular in the article insertion detection mode and in the article extraction detection mode, may be denoted as probe power pulses. Accordingly, the control circuitry may be configured to generate probe power pulses.

In the third case, that is, when the device is in a heating mode, the power pulses generated by the control circuitry may aim at heating the aerosol-forming substrate by pulsed heating. Therefore, the power pulses generated during a heating operation, in particular during the heating mode, may be denoted as heating power pulses. In addition, during a heating operation, that is, in the heating mode, the power pulses may also be used to monitor the device for the extraction of an aerosol-generating article from the cavity in order to stop heating operation. That is, the power pulses during the heating mode may also be used for detecting the extraction of an aerosol-generating article from the cavity by detecting a change of at least one property of the inductive heating arrangement due to the susceptor becoming absent from the article when the article is extracted from the cavity.

In general, the power pulse in the article insertion detection mode and in the article extraction detection mode may be identical. It is also possible that the power pulse in the article insertion detection mode and in the article extraction detection mode may differ from each other by at least one property, such as the amplitude of the power pulse, the pulse duration and the time interval between two consecutive power pulses. Likewise, the power pulse in the article insertion/extraction detection mode and in the heating mode may be identical. It is also possible that the power pulse in the insertion/extraction detection mode and in the heating mode, that is, the probe power pulses and the heating power pulses may differ from each other by at least one property, such as the amplitude of the power pulse, the pulse duration and the time interval between two consecutive power pulses. In particular, the amplitude of the heating power pulses may be larger than the amplitude of the probe power pulses. In addition, the probe power pulses may have a fixed pulse pattern, in particular a fixed periodicity. In contrast, the heating power pulses may have an unfixed, in particular variable pulse pattern, for example in case of a pulse width modulation of the heating power.

The control circuitry may be configured to disable the heating operation of the inductive heating arrangement in response to detecting the extraction of an article from the cavity during a heating operation. Likewise, the control circuitry may be configured to disable the heating operation of the inductive heating arrangement after a previous heating operation, and until after detecting the extraction of an article from the cavity. Advantageously, this prevents a user of the device from starting a new heating operation with a depleted aerosol-generating article. That is, a user is prevented from re-using an aerosol-generating article that has been already used in a previous user experience. Otherwise, re-heating a used aerosol-generating article may cause an unsatisfactory user experience since the used aerosol-generating article may not be able to generate aerosol at a level conforming with an unused aerosol-generating article. As a consequence, the user convenience of the device is improved as re-heating a used aerosol-generating article might otherwise cause an unsatisfactory user experience. Furthermore, safety may be improved because re-heating a used aerosol-generating article might cause damage to the heating arrangement.

Once the extraction of an article has been detected, disablement of the heating operation should be ceased. Accordingly, the control circuitry may be configured to enable activation of the heating operation of the inductive heating arrangement in response to detecting the extraction of an article from the cavity during a heating operation, and after disabling the heating operation. Likewise, the control circuitry may be configured to enable activation of the heating operation of the inductive heating arrangement after a previous heating operation, and in response to detecting the extraction of an article from the cavity.

In general, heating operation of the inductive heating arrangement may be activated manually, that is, by a user input. Alternatively or in addition, activation of the heating operation may be event-driven, that is, may occur in response to detecting a particular event. Preferably, the control circuitry is configured to start heating operation of the inductive heating arrangement in response to detecting the insertion of the article into the cavity. Advantageously, this enhances the user's convenience as heating operation automatically starts upon insertion of an article into the cavity without the need of any further user input. In particular, the user experience immediately starts as known from conventional cigarettes.

The control circuitry may further comprise a motion sensor for detecting movements of the aerosol-generating device. Advantageously, the motion sensor may enable to monitor the device for movements and thus, for example, to detect a user handling the device. That is, if the motion sensor detects movements of the aerosol-generating device, this means that a user is holding the device and therefore probably about to extract an aerosol-generating article from the cavity or to insert an article into the cavity and thus to start a new user experience. For example, the motion sensor may detect movements of the aerosol-generating device when the aerosol-generating device has been extracted from a power charging unit. If no movements are detected this typically means that the aerosol-generating device is in an idle phase. This might be the case, when the aerosol-generating device is placed in a power charging unit or is lying idle on a table.

As an example, the motion sensor may comprise at least one of an accelerometer for measuring accelerations or a gyroscope for measuring an angular orientation or an angular velocity of the device. That is, the motion sensor may be configured to detect at least one of accelerations, an angular orientation and or an angular velocity of the aerosol-generating device, in particular due to a user handling the device.

In order to avoid unnecessary pulse generation during idle phases, that is, during periods in which the aerosol-generating device is not used, the control circuitry may be further configured to start generating probe power pulses in response to detecting movements of the aerosol-generating device. In particular, the control circuit may be configured to start generating power pulses only in response to detecting movements of the aerosol-generating device. Hence, detection of device movements is used to trigger an article detection mode when a user is about to use the device. Advantageously, this allows to save electrical power and thus to increase the overall operation time of the aerosol-generating device.

Preferably, the control circuitry is configured to start generating power pulses, in particular probe power pulses, in response to detecting movement of the device reaching or exceeding a pre-determined motion threshold. The pre-determined motion threshold may be defined by an acceleration value, or angular value or an angular velocity value. The pre-determined acceleration threshold may be in a range between 0.5 g and 1.5 g, in particular between 0.7 g and 1.3 g, wherein g denotes the standard acceleration due to gravity which is defined by standard as 9.80665 $m/s^2$ [meter per square second].

The control circuitry may be configured to stop generating power pulses, in particular probe power pulses, after a predetermined time after detecting movement of the device reaching or exceeding a pre-determined motion threshold. The control circuitry may be further configured to stop generating power pulses, in particular probe power pulses, in response to detecting movements of the device not reaching the pre-determined motion threshold for a predetermined idle time, or in response to detecting no movements for a predetermined idle time. Advantageously, this procedure also helps to reduce the power consumption and, thus, to increase in the overall operation time of the device.

In order to further reduce the power consumption, the control circuitry may be configured to reduce a number of power pulses, in particular probe power pulses, per time unit, for example, by a factor of two or three, in response to detecting for a predetermined idle time movements of the device not reaching the pre-determined motion threshold or in response to detecting for a predetermined idle time no movements. The idle time may be in a range between 10 seconds and 90 seconds, in particular between 15 seconds and 60 seconds, preferably between 15 seconds and 40 seconds.

According to another configuration, the control circuitry may be configured to reduce a number of power pulses, in particular probe power pulses, per time unit, for example, by a factor of two of three, in response to detecting for a predetermined first idle time movements of the device not reaching the pre-determined acceleration threshold or in response to detecting for a predetermined first idle time movements no movements, and subsequently to stop generating power pulses, in particular probe power pulses, in response to detecting for a predetermined second idle time starting after the first idle time movements of the device not reaching the predetermined acceleration threshold or in response to detecting for a predetermined second idle time starting after the first idle time no movements. Advantageously, this configuration even further reduces the power consumption and, thus, increases the overall operation time of the device even more. The first idle time may be in a range between 5 seconds and 60 seconds, in particular between 10 seconds and 30 seconds, preferably between 15 seconds and 25 seconds. Likewise, the second idle time may be in a range between 10 seconds and 90 seconds, in particular between 15 seconds and 60 seconds, preferably between 15 seconds and 30 seconds.

Alternatively or in addition to triggering the article detection mode by monitoring the device for movements, the article detection mode may also be triggered by other events. For example, the article detection mode may be triggered by extracting the aerosol-generating device from a power charging unit used for re-charging the DC power supply of the device. For that purpose, the control circuit may be configured to detect the extraction of the aerosol-generating device from a power charging unit. Furthermore, the control circuit may be configured to start generating power pulses, in particular probe power pulses, in response to detecting the extraction of the aerosol-generating device from the power charging unit. This procedure may prove advantageous with regard to an automatic start of the article insertion detection. In particular, this procedure enhances the user's convenience as there is no need for a user to actively start the article detection mode upon re-charging of the aerosol-generating device.

Likewise, the control circuit may be configured to detect the insertion of the aerosol-generating device into a power charging unit. Based on this, the control circuit may be further configured to stop generating power pulses, in particular probe power pulses in response to detecting insertion of the aerosol-generating device into a power charging unit. Again, this procedure allows to avoid unnecessary power consumption as well as to enhance the user's convenience because there is no need for a user to actively stop the article detection mode prior to re-charging the DC power supply.

The control circuit may be configured to stop of the heating operation of the device subject to various conditions. In particular, the control circuit may be configured to stop heating operation of the device in response to at least one of detecting a pre-determined number of puffs, detecting that a pre-determined heating time has elapsed, or receiving a user input.

Advantageously, any of these conditions may subsequently initiate the detection of the extraction of an aerosol-generating article from the cavity. Accordingly, the control circuit may be configured to start generating power pulses, in particular probe power pulses, for detecting the extraction of the article in response to detecting a stop of the heating operation of the device. As mentioned above, this procedure also enhances the user's convenience as there is no need for a user to actively start the article detection mode upon the end of a user's experience.

It is also possible that the control circuitry is configured to stop heating operation of the inductive heating arrangement in response to detecting the extraction of the article from the cavity. Advantageously, this configuration may be used to abort heating operation, for example, if an aerosol-generating article has been extracted untimely, for example, before expiration of the predetermined heating time or before expiration of the predetermined number of puffs or before a user input. To this extent, detection of the extraction of an article from the cavity may be considered as a further condition triggering a stop of the heating operation. Likewise, it is also possible that heating operation is stopped only in response to detecting the extraction of the article from the cavity.

The control circuitry may be configured to verify the insertion of an article into the cavity or the extraction of an article from the cavity by generating at least one verifying power pulse a pre-determined period of time after a first detection of the change of the at least one property of the inductive heating arrangement and by re-detecting the change of at least one property of the inductive heating arrangement.

In order to generate the power pulses for intermittently powering on the inductive heating arrangement, the control circuitry may comprise a switch configured and arranged to control a supply of power from the DC power supply to the inductive heating arrangement. For this, the switch may be intermittently closed and opened such as to intermittently power on the inductive heating arrangement in order to detect at least one of the insertion of an aerosol-generating article into the cavity in order to start heating operation, the extraction of an aerosol-generating article from the cavity after a heating operation in order to enable heating operation to be restarted, or the extraction of an aerosol-generating article from the cavity during heating operation in order to stop the heating operation.

As described before, the first two scenarios relate to the detection of the insertion of an article into the cavity and the extraction of an aerosol-generating article from the cavity during an article detection mode or an article detection operation of the aerosol-generating device, in particular to an article insertion detection mode and an article extraction detection mode, respectively. In contrast, the third scenario relates to the detection of the extraction of an aerosol-generating article from the cavity during heating operation or a heating mode of the device. To this extend, the switch may also be used to intermittently power on the inductive heating arrangement during the heating mode of the device in order to generate power pulses for pulsed heating of the aerosol-forming substrate. Accordingly, this mode may be denoted as pulsed heating mode. In that mode, the power pulses may also be used to monitor the device for the extraction of an aerosol-generating article from the cavity in order to stop heating operation.

It is also possible that during the heating operation of the aerosol-generating device the switch may be permanently closed to continuously apply a DC voltage from the DC power supply to the inductive heating arrangement. Accordingly, this mode may be denoted as continuous heating mode. In the continuous heating mode, the control circuitry may also be able to detect the extraction of an article from the cavity by detecting a change of at least one property of the inductive heating arrangement due to the susceptor becoming absent from within the cavity when an aerosol-generating article is extracted from the cavity like in the pulsed mode.

The change of the property may be observed by measuring a change in a parameter of the inductive heating arrangement. The parameter may be measured either directly or indirectly. The susceptor, and thus the article becoming present in or absent from the cavity may be determined by measuring the parameter and observing that the parameter has a different value in the presence of the susceptor as compared to the value in the absence of the susceptor. Preferably, the parameter may be a current. Accordingly, the control circuitry may comprise a measurement device for measuring a current indicative of the at least one property of the inductive heating arrangement. In particular, the parameter may be a DC current supplied from the DC power supply to the inductive heating arrangement. Accordingly, the control circuitry may comprise a measurement device arranged and configured for measuring a DC current supplied from the DC power supply to the inductive heating arrangement. For that purpose, the measurement device may comprise a DC current measurement device arranged in series connection between the DC power supply and the inductive heating arrangement. For example, the measurement device may comprise a resistance and a shunt amplifier. Accordingly, when an aerosol-generating article is inserted into the cavity of the aerosol-generating device, the susceptor becoming present in the cavity increases the equivalent resistance due to an increase of the resistive load. This in turn causes a decrease of the DC current feeding the inductive heating arrangement. The decrease of the DC current is detected by the current measurement device of the control circuitry which subsequently may activate a heating operation of the inductive heating arrangement for heating the substrate. Likewise, when an aerosol-generating article is extracted from the cavity of the aerosol-generating device, the susceptor becoming absent from the cavity decreases the equivalent resistance due to a decrease of the resistive load. This in turn causes an increase of the DC current feeding the inductive heating arrangement. The increase of the DC current is detected by the current measurement device of the control circuitry which subsequently may enable a next heating operation.

In general, the pulse duration and the time interval between two consecutive power pulses, in particular probe power pulses, used for article detection, in particular for detecting the insertion of an article into in the cavity or the extraction of an article from the cavity, should be selected such as to balance the effect of energy depletion and user experience performance. The probe pulse duration should be kept as short as possible, but still long enough to provide a reliable measurement of the current pulses. Likewise, the higher the time interval between two consecutive power pulses, in particular probe power pulses, the lower the energy depletion. However, the time interval between two consecutive power pulses, in particular probe power pulses, should not be too long, otherwise, a user might have to wait too long for the user experience to start.

Taking these considerations into account, the power pulses, in particular probe power pulses, may have a pulse duration in a range between 1 microsecond and 500 microseconds, in particular between 10 microseconds and 300 microseconds, preferably between 15 microseconds and 120 microseconds, most preferably between 30 microseconds to 100 microseconds.

As used herein, the term "pulse duration" denotes the time interval during which the heating arrangement is powered on, in particular during which the switch mentioned above is closed.

The time interval between two consecutive power pulses, in particular probe power pulses, may be in a range between 50 milliseconds and 2 seconds, in particular between 100 milliseconds and 2 seconds, preferably between 500 milliseconds and 1 second.

The sum of the pulse duration time and the time interval between two consecutive power pulses may be denoted as the polling time, that is, the difference in time between the start of a pulse and the start of the following one. The polling time may be in a range between 50 milliseconds and 2.5 seconds, in particular between 51 milliseconds and 2.5 milliseconds, more particularly between 100 milliseconds and 2 seconds, preferably between 500 milliseconds and 1 second.

Preferably, for article detection the power pulses, in particular probe power pulses, are generated for a predetermined period of time. That is, the detection mode may last a finite predetermined period of time. In case no insertion or extraction of an article has been detected within the predetermined period of time, the detection mode may be stopped, that is, the generation of the power pulses may be turned off in order to safe electrical power, as described above. Likewise, in case the insertion or extraction of an article is detected within the predetermined period of time, the detection mode may be stopped, in particular immediately, in response to detecting the insertion or extraction of the article.

As further described above, during heating operation, the power pulses may be generated for a predetermined number of puffs or a predetermined heating time or until receiving an input from a switch, in particular a user's input. In particular, the heating mode may include a pulse width modulation of the heating power pulses for controlling the heating temperature.

In general, the detection mode (detection operation) and the heating mode (heating operation) may differ from each other by at least one characteristic of the power pulses, in particular by at least one of the period of time or the pulse pattern. For example, the detection mode may include a fixed pulse pattern of power pulses, in particular probe power pulses. In contrast, the heating mode may include an unfixed, in particular variable pulse pattern of power pulses, in particular heating power pulses, for example in case of a pulse width modulation of the power pulses.

The inductive heating arrangement may be configured to generate a high-frequency alternating magnetic field. As referred to herein, the high-frequency alternating magnetic field may be in the range between 500 kHz (kilo-Hertz) to 30 MHz (Mega-Hertz), in particular between 5 MHz (Mega-Hertz) to 15 MHz (Mega-Hertz), preferably between 5 MHz (Mega-Hertz) and 10 MHz (Mega-Hertz).

For generating the alternating magnetic field, the inductive heating arrangement may comprise DC/AC converter connected to the DC power supply. The DC/AC converter may include an LC network. For example, the DC/AC converter may comprise a Class-C power amplifier or a Class-D power amplifier or Class-E power amplifier. In particular, the DC/AC converter may comprise a transistor switch and a transistor switch driver circuit and an LC network. The LC network may comprise a series connection of a capacitor and an inductor, and wherein the inductor is configured and arranged to generate the alternating magnetic field within the cavity, in particular for inductively heating the susceptor and for article detection. The LC network may further comprise a shunt capacitor in parallel to the transistor switch. In addition, DC/AC converter may comprise a choke inductor for supplying a DC supply voltage +V_DC from to the DC power source.

The inductor used to generate the alternating magnetic field within the cavity for inductively heating the susceptor and for article detection may comprise at least one induction coil, in particular a single induction coil or a plurality of induction coils. The number of induction coils may depend on the size and/or number of susceptors. The induction coil or coils may have a shape matching the shape of the one or more susceptors in the aerosol-generating article. Likewise, the induction coil or coils may have a shape to conform to a shape of a housing of the aerosol-generating device.

The at least one induction coil may be a helical coil or flat planar coil, in particular a pancake coil or a curved planar coil. Use of a flat spiral coil allows for compact design that is robust and inexpensive to manufacture. Use of a helical induction coil advantageously allows for generating a homogeneous alternating electromagnetic field. As used herein a "flat spiral coil" means a coil that is generally planar coil, wherein the axis of winding of the coil is normal to the surface in which the coil lies. The flat spiral induction can have any desired shape within the plane of the coil. For example, the flat spiral coil may have a circular shape or may have a generally oblong or rectangular shape. However, the term "flat spiral coil" as used herein covers both, coils that are planar as well as flat spiral coils that are shaped to conform to a curved surface. For example, the induction coil may be a "curved" planar coil arranged at the circumference of a preferably cylindrical coil support, for example ferrite core. Furthermore, the flat spiral coil may comprise for example two layers of a four-turn flat spiral coil or a single layer of four-turn flat spiral coil.

The at least one induction coil can be held within one of a housing of the heating arrangement, or a main body or a housing of an aerosol-generating device which comprises the heating arrangement. The at least one induction coil may be wound around a preferably cylindrical coil support, for example a ferrite core.

The inductive heating arrangement may be configured to generate the alternating magnetic field continuously following activation of the system or intermittently, such as on a puff by puff basis.

The control circuit may further be configured to control the overall operation of the aerosol-generating device. The control circuitry and at least parts of the inductive heating arrangement may be integral part of an overall electrical circuitry of the aerosol-generating device.

The control circuitry may comprise a microprocessor, for example a programmable microprocessor, a microcontroller, or an application specific integrated chip (ASIC) or other electronic circuitry capable of providing control. The control circuitry may comprise at least one of a transimpedance amplifier for current-to-voltage conversion, an inverting signal amplifier, a single-ended to-differential converter, an analog-digital converter and a micro-controller.

The microprocessor may be configured to at least one of: to control the switch used to generate power pulses for intermittently powering on the inductive heating arrangement, to read out the measurement device for measuring the current supplied from the DC power supply to the inductive heating arrangement, and to control the transistor switch driver circuit of the inductive heating arrangement.

The control circuitry may be or may be art of an overall controller of the aerosol-generating device.

The controller and at least a portion of the induction source, in particular the induction source apart from the inductor, may be arranged at a common printed circuit board. This proves particularly advantageous with regard to a compact design of the heating arrangement.

Preferably, the DC power supply comprises at least one battery, such as a lithium iron phosphate battery. As an alternative, the power supply may comprise another form of charge storage device such as a capacitor. The power supply may require recharging, that is, the power supply may be rechargeable. The power supply may have a capacity that allows for the storage of enough energy for one or more user experiences. For example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the induction source. The power supply may be an overall power supply of aerosol-generating device according to the present invention.

The receiving cavity may comprise an insertion opening through which an aerosol-generating article may be inserted into the receiving cavity. As used herein, the direction in which the aerosol-generating article is inserted is denoted as insertion direction. Preferably, the insertion direction corresponds to the extension of a length axis, in particular a center axis of the receiving cavity.

Upon insertion into the receiving cavity, at least a portion of the aerosol-generating article may still extend outwards through the insertion opening. The outwardly extending portion preferably is provided for interaction with a user, in particular for being taken into a user's mouth. Hence, during use of the device, the insertion opening may be close to the mouth. Accordingly, as used herein, sections close to the insertion opening or close to a user's mouth in use of the device, respectively, are denoted with the prefix "proximal". Sections which are arranged further away are denoted with the prefix "distal".

With regard to this convention, the receiving cavity may be arranged or located in a proximal portion of the aerosol-generating device. The insertion opening may be arranged or located at a proximal end of the aerosol-generating device, in particular at a proximal end of the receiving cavity.

Likewise, the receiving cavity may be formed as a cavity, in particular as an elongate cavity, which comprises a distal end portion and a proximal end portion. If present, an insertion opening may be arranged at a proximal end of the receiving cavity. At a distal end, the receiving cavity may comprise a bottom opposite to the insertion opening.

The aerosol-generating device may comprise an air path extending from at least one air inlet into the receiving cavity. That is, the aerosol-generating device may comprise at least one air inlet in fluid communication with the receiving cavity. When an aerosol-generating article is inserted into the cavity, the air path may further extend through the aerosol-forming substrate within the article and a mouthpiece of the article into a user's mouth. Preferably, the air inlet is realized at an insertion opening of the receiving cavity used for inserting the article into the cavity. Accordingly, when the article is received in the cavity, air may be drawn into the receiving cavity at the rim of the insertion opening and further through an air flow passage formed between the outer circumference of the aerosol-generating article and at least one or more portions of the inner surface of the receiving cavity.

In general, the receiving cavity may have any suitable shape. In particular, the shape of the receiving cavity may correspond to the shape of the aerosol-generating article to be received therein. Preferably, the receiving cavity may have a substantially cylindrical shape or a tapered shape, for example, a substantially conical or a substantially frusto-conical shape.

Likewise, the receiving cavity may have any suitable cross-section as seen in a plane perpendicular to a length axis of the receiving cavity or perpendicular to an insertion direction of the article. In particular, the cross-section of the receiving cavity may correspond to the shape of the aerosol-generating article to be received therein. Preferably, the receiving cavity has a substantially circular cross-section. Alternatively, the receiving cavity may have a substantially elliptical cross-section or a substantially oval cross-section or a substantially square cross-section or a substantially rectangular cross-section or a substantially triangular cross-section or a substantially polygonal cross-section. As used herein, the above mentioned shapes and cross-sections preferably refer a shape or a cross-section of the receiving cavity without considering any protrusions at the inner surface of the receiving cavity.

The inductor may be arranged such as to surround at least a portion of the receiving cavity or at least a portion of the inner surface of the receiving cavity, respectively. The inductor may be, for example a helical coil, arranged within a side wall of the receiving cavity. In particular, the inductor may be integrated in a wall defining the receiving cavity. For example, the inductor may be integrated in a side wall of the receiving cavity, in particular such as to surround at least a portion of the interior of the receiving cavity.

The receiving cavity may comprise a plurality of protrusions extending in the interior of the receiving cavity. Preferably, the protrusions are distanced from each other such that an air flow passage is formed in between neighboring protrusions, that is, by the interstices (free space) between neighboring protrusions. In addition, the plurality or protrusions may be configured to contact at least a portion of the aerosol-generating article for retention of the aerosol-generating article in the receiving cavity. The plurality of protrusions may comprise or may be formed as a rib. Preferably, the one or more ribs extend along a direction of a length axis, in particular a center axis of the receiving cavity. Preferably, the length axis of the receiving cavity corresponds to an insertion direction along which an aerosol-generating article is insertable into the receiving cavity.

The aerosol-generating device may further comprises optical or haptic indication means for indicating the detection of at least one of the extraction of an article from the cavity, the insertion of the article into the cavity, disablement or enablement of heating operation of the inductive heating arrangement. Advantageously, such indication means may enhance the ease of use and the user's convenience.

The present invention further relates to an aerosol-generating system comprising an aerosol-generating device according to the invention and as described herein. The system further comprises an aerosol-generating article, wherein at least a portion of the article is removably receivable or removably received in the receiving cavity of the device. The article includes at least one aerosol-forming substrate and an inductively heatable susceptor for heating the substrate when the article is received in the cavity.

The aerosol-generating article may be a consumable, in particular intended for single use. The aerosol-generating article may be a tobacco article. In particular, the article may be a rod-shaped article, preferably a cylindrical rod-shaped article, which may resemble conventional cigarettes.

The article may comprise one or more of the following elements: a first support element, a substrate element, a second support element, a cooling element, and a filter element. Preferably, the aerosol-generating article comprises at least a first support element, a second support element and a substrate element located between the first support element and the second support element.

All of the aforementioned elements may be sequentially arranged along a length axis of the article in the above described order, wherein the first support element preferably is arranged at a distal end of the article and the filter element preferably is arranged at a proximal end of the article. Each of the aforementioned elements may be substantially cylindrical. In particular, all elements may have the same outer cross-sectional shape. In addition, the elements may be circumscribed by an outer wrapper such as to keep the elements together and to maintain the desired cross-sectional shape of the rod-shaped article. Preferably, the wrapper is made of paper.

As used herein, the term "aerosol-forming substrate" relates to a substrate capable of releasing volatile compounds that can form an aerosol when heated. The aerosol-forming substrate may be a solid aerosol-forming substrate or a liquid aerosol-forming substrate or gel-like aerosol-forming substrate. The aerosol-forming substrate may comprise a tobacco-containing material containing volatile tobacco flavor compounds, which are released from the substrate upon heating. Alternatively or additionally, the aerosol-forming substrate may comprise a non-tobacco material. The aerosol-forming substrate may further comprise an aerosol former. Examples of suitable aerosol formers are glycerin and propylene glycol. The aerosol-forming substrate may also comprise other additives and ingredients, such as nicotine or flavoring substances. In particular, liquid aerosol-forming substrate may include water, solvents, ethanol, plant extracts and natural or artificial flavors. The aerosol-forming substrate may also be a paste-like material, a sachet of porous material comprising aerosol-forming substrate, or, for example, loose tobacco mixed with a gelling agent or sticky agent, which could include a common aerosol former such as glycerin, and then is compressed or molded into a plug.

The substrate element preferably comprise the at least one aerosol-forming substrate to be heated. The substrate element may further comprise the susceptor which is in thermal contact with or thermal proximity to the aerosol-forming substrate. As used herein, the term "susceptor" refers to an element comprising a material that is capable of being inductively heated within an alternating electromagnetic field. This may be the result of at least one of hysteresis losses or eddy currents induced in the susceptor, depending on the electrical and magnetic properties of the susceptor material.

The susceptor may comprise a variety of geometrical configurations. The susceptor may be one of a particulate susceptor, or a susceptor filament, or a susceptor mesh, or a susceptor wick, or a susceptor pin, or a susceptor rod, or a susceptor blade, or a susceptor strip, or a susceptor sleeve, or a susceptor cup or a cylindrical susceptor, or a planar susceptor. For example, the susceptor may be an elongated susceptor strip having a length in a range of 8 mm (millimeter) to 16 mm (millimeter), in particular, 10 mm (millimeter) to 14 mm (millimeter), preferably 12 mm (millimeter). A width of the susceptor strip may be, for example, in a range of 2 mm (millimeter) to 6 mm (millimeter), in particular, 4 mm (millimeter) to 5 mm (millimeter). A thickness of the susceptor strip preferably is in a range of 0.03 mm (millimeter) to 0.15 mm (millimeter), more preferably 0.05 mm (millimeter) to 0.09 mm (millimeter).

The susceptor may be a multi-layer susceptor, for example a multi-layer susceptor strip. In particular, the multi-layer susceptor may comprise a first susceptor material and a second susceptor material. The first susceptor material preferably is optimized with regard to heat loss and thus heating efficiency. For example, the first susceptor material may be aluminum, or a ferrous material such as a stainless steel. In contrast, the second susceptor material preferably is used as temperature marker. For this, the second susceptor material is chosen such as to have a Curie temperature corresponding to a predefined heating temperature of the susceptor assembly. At its Curie temperature, the magnetic properties of the second susceptor change from ferromagnetic to paramagnetic, accompanied by a temporary change of its electrical resistance. Thus, by monitoring a corresponding change of the electrical current absorbed by the induction source it can be detected when the second susceptor material has reached its Curie temperature and, thus, when the predefined heating temperature has been reached. The second susceptor material preferably has a Curie temperature that is below the ignition point of the aerosol-forming substrate, that is, preferably lower than 500 degrees Celsius. Suitable materials for the second susceptor material may include nickel and certain nickel alloys.

At least one of the first support element and the second support element may comprise a central air passage. Preferably, at least one of the first support element and the second support element may comprise a hollow cellulose acetate tube. Alternatively, the first support element may be used to cover and protect the distal front end of the substrate element.

The aerosol-cooling element is an element having a large surface area and a low resistance to draw, for example 15 mmWG to 20 mmWG. In use, an aerosol formed by volatile compounds released from the substrate element is drawn through the aerosol-cooling element before being transported to the proximal end of the aerosol-generating article.

The filter element preferably serves as a mouthpiece, or as part of a mouthpiece together with the aerosol-cooling element. As used herein, the term "mouthpiece" refers to a portion of the article through which the aerosol exits the aerosol-generating article.

Further features and advantages of the aerosol-generating system and the aerosol-generating article according to the present invention have already been described above with regard to aerosol-generating device according to the present invention and equally apply.

The present invention further relates to an aerosol-generating article of an aerosol-generating system according to present invention or for use with an aerosol-generating device according to present invention. The aerosol-generating article comprises an aerosol-forming substrate and an inductively heatable susceptor for heating the substrate. Further features and advantages of the aerosol-generating article have already been described above with regard to aerosol-generating device and the aerosol-generating system according to the present invention and equally apply.

The present invention further relates to a method of operating an aerosol-generating device for heating an aerosol-forming substrate that is capable to form an inhalable aerosol when heated. The device comprises a DC power supply and a cavity for removably receiving at least a portion of an aerosol-generating article which includes the aerosol-forming substrate and an inductively heatable susceptor for heating the substrate. The device further comprises an inductive heating arrangement connected to the DC power supply and configured to generate an alternating magnetic field within the cavity for inductively heating the susceptor of the article in a heating operation when the article is received in the cavity. In particular, the aerosol-generating device may be an aerosol-generating device according to the present invention as described before. The method comprises:

operating the device in an article extraction detection mode, by generating power pulses, in particular probe power pulses to intermittently power on the inductive heating arrangement;

measuring for each power pulse at least one property of the inductive heating arrangement which is affected by the susceptor becoming absent from the cavity in response to extracting an aerosol-generating article from the cavity of the device, and detecting whether a change of the at least one property of the inductive heating arrangement has occurred as compared to one or more previous power pulses, thus indicating the extraction of an aerosol-generating article into the cavity; and stopping operating the device in the article extraction detection mode in response to detecting a change of the at least one property of the inductive heating arrangement.

The method may further comprise:

operating the device in an article insertion detection mode, by generating power pulses, in particular probe power pulses to intermittently power on the inductive heating arrangement;

measuring for each power pulse at least one property of the inductive heating arrangement which is affected by the susceptor becoming present in the cavity in response to inserting an aerosol-generating article into the cavity of the device, and detecting whether a change of the at least one property of the inductive heating arrangement has occurred as compared to one or more previous power pulses, thus indicating the insertion of an aerosol-generating article into the cavity; and stopping operating the device in the article insertion detection mode in response to detecting a change of the at least one property of the inductive heating arrangement;

operating the device in a heating mode by activating heating operation of the inductive heating arrangement for heating the substrate.

In general, operating the device in the article insertion detection mode and operating the device in the heating mode may occur prior or after or prior as well as after operating the device in the article extraction detection mode. That is, the method may comprise a cycle of operating the device in an article insertion detection mode, operating the device in a heating mode and operating the device in an article extraction detection mode.

As mentioned above with regard to the aerosol-generating device according to the present invention, the power pulses, in particular the probe power pulses may have a pre-determined pulse duration and a pre-determined time interval between two consecutive power pulses, in particular probe power pulses. The pre-determined pulse duration may be in a range between 1 microsecond and 500 microseconds, in particular between 10 microseconds and 300 microseconds, preferably between 15 microseconds and 120 microseconds, most preferably between 30 microseconds to 100 microseconds. The time interval between two consecutive power pulses, in particular probe power pulses may be in a range between 50 milliseconds and 2 seconds, in particular between 100 milliseconds and 2 seconds, preferably between 500 milliseconds and 1 second.

As further mentioned above with regard to the aerosol-generating device according to the present invention, the at least one property preferably is at least one of an equivalent resistance of the inductive heating arrangement. The equivalent resistance may be measured via a DC current supplied from the DC power supply to the inductive heating arrangement.

Accordingly, at least one of operating the device in an article extraction detection mode or operating the device in an article insertion detection mode comprises:

measuring for each pulse an equivalent resistance of the inductive heating arrangement by measuring a DC current supplied from the DC power supply to the inductive heating arrangement, and detecting whether a change of the DC current and, thus, of the equivalent resistance of the inductive heating arrangement has occurred as compared to previous pulses, thus indicating the extraction of an aerosol-generating article from the cavity or the insertion of an aerosol-generating article into the cavity, respectively; and stopping operating the device in the article extraction detection mode or operating the device in the article insertion detection mode, respectively, in response to detecting a change of the DC current and, thus, of the equivalent resistance of the inductive heating arrangement.

Preferably, the article extraction detection mode may be triggered by a stop of a previous heating operation of the inductive heating arrangement.

In order to prevent a user from re-using an aerosol-generating article already used in a previous heating operation, operating the device in a heating mode may be disabled during operating the device in an article extraction detection mode. Likewise, operating the device in the heating mode may be enabled in response to stopping operating the device in the article extraction detection.

In order to reduce the power consumption and, thus, to increase the overall operation time of the device addition, the method may further comprise operating the device in a stand-by mode after stopping generating power pulses, in particular probe power pulses, or prior to starting generating power pulses, in particular probe power pulses, in the article extraction detection mode or in the article insertion detection mode, respectively, by:

monitoring the device for movements; and starting operating the device in the article extraction detection mode or in the article insertion detection mode, respectively, in response to detecting movements of the device or movements of the device reaching or exceeding a pre-determined acceleration threshold.

The stand-by mode may be stopped in response to detecting the inserting of the device into the charging unit.

Also in order to avoid unnecessary power consumption, the method may further comprise:

operating the device in an idle state monitoring mode during at least one of operating the device in the article extraction detection mode or operating the device in the article insertion detection mode by:

monitoring the device for movements; and stopping operating the device in the article extraction detection mode or in the article insertion detection mode, respectively, in response to measuring no movements of the device for a predetermined idle time.

For the same reason, yet according to another configuration, the method may comprise:

operating the device in an idle state monitoring mode during at least one of operating the device in the article extraction detection mode or operating the device in the article insertion detection mode by:

monitoring the device for movements; and reducing a number of power pulses, in particular probe power pulses, per time unit, for example, by a factor of two or three, in response to detecting for a predetermined idle time movements of the device not reaching a pre-determined acceleration threshold or in response to detecting for a predetermined idle time no movements.

The idle time may be in a range between 10 seconds and 90 seconds, in particular between 15 seconds and 60 seconds, preferably between 15 seconds and 40 seconds.

According to another alternative configuration, the method may comprise:

operating the device in an idle state monitoring mode during at least one of operating the device in the article extraction detection mode or operating the device in the article insertion detection mode by:

measuring movements of the device;

reducing a number of power pulses, in particular probe power pulses, per time unit, for example, by a factor of two or three, in response to detecting for a predetermined first idle time movements of the device not reaching a predetermined acceleration threshold or in response to detecting for a predetermined first idle time no movements, and subsequently stopping generating power pulses, in particular probe power pulses, in response to detecting for a predetermined second idle time starting after the first idle time movements of the device not reaching the pre-determined acceleration threshold or in response to detecting for a predetermined second idle time starting after the first idle time no movements.

The first idle time may be in a range between 5 seconds and 60 seconds, in particular between 10 seconds and 30 seconds, preferably between 15 seconds and 25 seconds. Likewise, the second idle time may be in a range between 10 seconds and 90 seconds, in particular between 15 seconds and 60 seconds, preferably between 15 seconds and 30 seconds.

The article detection mode may be triggered by extracting the aerosol-generating device from a power charging unit. Advantageously, this procedure enhances the user's convenience as there is no need for a user to actively start the article detection mode upon re-charging of the aerosol-generating device.

According to yet another aspect of the invention there is provided an aerosol-generating device for heating an aerosol-forming substrate that is capable to form an inhalable aerosol when heated. The device comprises a cavity for removably receiving at least a portion of an aerosol-generating article, wherein the article includes the aerosol-forming substrate and an inductively heatable susceptor for heating the substrate. The device also comprises a DC power supply and an inductive heating arrangement which is connected to the DC power supply and configured to generate an alternating magnetic field within the cavity for inductively heating the susceptor of the article when the article is received in the cavity. The device further comprises a control circuitry configured to generate power pulses for intermittently powering on the inductive heating arrangement and to detect a change of at least one property of the inductive heating arrangement due to the presence of the susceptor when an aerosol-generating article is received in the cavity, thus enabling to detect the insertion of the article into the cavity.

According to the invention it has been recognized that the inductive heating arrangement may be used not only for heating the substrate, but also for detecting the insertion of an aerosol-generating article into the receiving cavity of the device. Thus, the inductive heating arrangement may be used for multiple purposes. Advantageously, this enables to avoid additional assembly space for separate sensor means. Moreover, it has been recognized that operating the inductive heating arrangement in a pulsed mode for the purpose of article detection advantageously reduces the power consumption and, thus, increases the overall operation time of the device as compared to other solutions.

According to the present invention article insertion detection is based on the fact that insertion of the article into the cavity modifies at least one property, in particular at least one electrical and/or magnetic property of the inductive heating arrangement due to the presence of the susceptor in the vicinity of the inductive heating arrangement. The change of at least one property caused by the presence of the susceptor may be due to an interaction between the field of the inductive heating arrangement and the susceptor.

The at least one property of the inductive heating arrangement may be any property having an associated parameter which has a different value in the presence of the susceptor as compared to the value in the absence of the susceptor. For example, the at least one property may be current, voltage, resistance, frequency, phase shift, flux, and inductance of the inductive heating arrangement.

Preferably, the property is at least one of an equivalent resistance or an inductance of the inductive heating arrangement. As used herein, the term "equivalent resistance" refers to the real part of a complex impedance defined as the ratio of the supplied AC voltage to the measured AC current. Accordingly, the "equivalent resistance" may also be denoted as the resistive load of the inductive heating arrangement. Likewise, as used herein, the term "inductance" refers to the imaginary part of a complex impedance defined as the ratio of the supplied AC voltage to the measured AC current. Inductance, generally speaking, includes the property of an electric circuit to be susceptible to exterior electromagnetic influences.

The change of at least one property of the inductive heating arrangement may be due to a specific magnetic permeability and/or a specific electrical resistivity of the susceptor. That is, the susceptor within the aerosol-generating article may include a material having a specific magnetic permeability and/or a specific electrical resistivity. Preferably, the susceptor comprises an electrically conductive material. For example, the susceptor may comprise a metallic material. The metallic material may be, for example, one of aluminum, nickel, iron, or alloys thereof, for example, carbon steel or ferritic stainless steel. Aluminum has an electrical resistivity of about 2.65×10E-08 Ohm-meter, measured at room temperature (20° C.), and a magnetic permeability of about 1.256×10E-06 Henry per meter. Likewise, ferritic stainless steel has an electrical resistivity of about 6.9×10E-07 Ohm-meter, measured at room temperature (20°

C.), and a magnetic permeability in a range of 1.26×10E-03 Henry per meter to 2.26×10E-03 Henry per meter.

Preferably, the control circuitry is further configured to (automatically) activate heat operation of the inductive heating arrangement for heating the substrate upon detecting the insertion of the article into the cavity. Due to this, the user of the device advantageously does not need to perform any additional actions to initiate the heating process upon inserting the aerosol-generating article into the cavity of the device. For example, the user of the device does not need operate a user interface such as pushing a button. Instead, the user experience immediately and irreversibly starts as known from conventional cigarettes.

In order to generate the power pulses for intermittently powering on the inductive heating arrangement, the control circuitry may comprise a switch configured and arranged to control a supply of power from the DC power supply to the inductive heating arrangement. For this, the switch may be intermittently closed and opened such as to intermittently power on the inductive heating arrangement for article detection, in particular for detecting the insertion of an article into in the cavity, that is, during an article detection mode of the aerosol-generating device. In contrast, during the heating mode of the aerosol-generating device the switch may be permanently closed to continuously apply a DC voltage from the DC power supply to the inductive heating arrangement. Accordingly, this mode may be denoted as continuous heating mode. Alternatively, the switch may be intermittently closed and opened during the heating mode of the aerosol-generating device such as to generate power pulses for pulsed heating of the aerosol-forming substrate. Accordingly, this mode may be denoted as pulsed heating mode.

The power pulses generated for article detection, in particular for detecting the insertion of an article into in the cavity, may be denoted as probe power pulses. Likewise, the power pulses generated for pulsed heating of the aerosol-forming substrate may be denoted as heating power pulses.

The change of the property may be observed by measuring a change in a parameter of the inductive heating arrangement. The parameter may be measured either directly or indirectly. The presence of the susceptor, and therefore the article, may be determined by measuring the parameter and observing that the parameter has a different value in the presence of the susceptor compared to the value in the absence of the susceptor. Preferably, the parameter may be a current. Accordingly, the control circuitry may comprise a measurement device for measuring a current indicative of the at least one property of the inductive heating arrangement. In particular, the parameter may be a DC current supplied from the DC power supply to the inductive heating arrangement. Accordingly, the control circuitry may comprise a measurement device arranged and configured for measuring a DC current supplied from the DC power supply to the inductive heating arrangement. That is, the measurement device may comprise a DC current measurement device arranged in series connection between the DC power supply and the inductive heating arrangement. For example, the measurement device may comprise a resistance and a shunt amplifier. Accordingly, when an aerosol-generating article is inserted into the cavity of the aerosol-generating device, the presence of the susceptor increases the equivalent resistance due to an increase of the resistive load. This in turn causes a decrease of the DC current feeding the inductive heating arrangement. The decrease of the DC current is detected by the current measurement device of the control circuitry which activates a heat operation of the inductive heating arrangement for heating the substrate.

In general, the pulse duration and the time interval between two consecutive power pulses used for article detection, in particular for detecting the insertion of an article into in the cavity, i.e. the time interval between two consecutive probe power pulses should be selected such as to balance the effect of energy depletion and user experience performance. The pulse duration should be kept as short as possible, but still long enough to provide a reliable measurement of the current pulses. Likewise, the higher the time interval between two consecutive power pulses, the lower the energy depletion. However, the time interval between two consecutive power pulses should not be too long, otherwise, a user might have to wait too long for the user experience to start.

Taking these considerations into account, the power pulses used for article detection, i.e. the probe power pulses, may have a pulse duration in a range between 1 microsecond and 500 microseconds, in particular between 10 microseconds and 300 microseconds, preferably between 15 microseconds and 120 microseconds, most preferably between 30 microseconds to 100 microseconds. As used herein, the term "pulse duration" denotes the time interval during which the heating arrangement is powered on, in particular during which the switch mentioned above is closed.

The time interval between two consecutive power pulses used for article detection, i.e. the time interval between two consecutive probe pulses, may be in a range between 50 milliseconds and 2 seconds, in particular between 100 milliseconds and 2 seconds, preferably between 500 milliseconds and 1 second.

Preferably, for article detection the probe power pulses are generated for a predetermined period of time. That is, the detection mode may last a finite predetermined period of time. In case no insertion of an article has been detected within the predetermined period of time, the detection mode may be stopped, that is, the generation of the power pulses may be turned off in order to safe electrical power. Likewise, in case the insertion of an article is detected within the predetermined period of time, the detection mode may be stopped, in particular immediately, in response to detecting the insertion of the article.

The heating power pulses may be generated for a predetermined number of puffs or a predetermined heating time or until receiving an input from a switch, in particular a user's input. In particular, the heating mode may include a pulse width modulation of the heating power pulses for controlling the heating temperature.

In general, the detection mode and the heating mode may differ from each other by at least one characteristic of the power pulses, in particular by at least one of the period of time or the pulse pattern. For example, the detection mode may include a fixed pulse pattern of probe power pulses. In contrast, the heating mode may include an unfixed, in particular variable pulse pattern of heating power pulses, for example in case of a pulse width modulation of the heating power pulses.

The inductive heating arrangement may be configured to generate a high-frequency alternating magnetic field. As referred to herein, the high-frequency alternating magnetic field may be in the range between 500 kHz (kilo-Hertz) to 30 MHz (Mega-Hertz), in particular between 5 MHz (Mega-Hertz) to 15 MHz (Mega-Hertz), preferably between 5 MHz (Mega-Hertz) and 10 MHz (Mega-Hertz).

For generating the alternating magnetic field, the inductive heating arrangement may comprise DC/AC converter connected to the DC power supply. The DC/AC inverter may comprise a Class-C power amplifier or a Class-D power amplifier or Class-E power amplifier. In particular, the DC/AC converter may comprise a transistor switch, a transistor switch driver circuit and an LC network. the LC network may comprises a series connection of a capacitor and an inductor, and wherein the inductor is configured and arranged to generate the alternating magnetic field within the cavity for inductively heating the susceptor. The LC network may further comprise a shunt capacitor in parallel to the transistor switch. In addition, DC/AC converter may comprise may comprise a choke inductor for supplying a DC supply voltage +V_DC from to the DC power source The inductor used to generate the alternating magnetic field within the cavity for inductively heating the susceptor may comprise at least one induction coil, in particular a single induction coil or a plurality of induction coils. The number of induction coils may depend on the size and/or number of susceptors. The induction coil or coils may have a shape matching the shape of the one or more susceptors in the aerosol-generating article. Likewise, the induction coil or coils may have a shape to conform to a shape of a housing of the aerosol-generating device.

The at least one induction coil may be a helical coil or flat planar coil, in particular a pancake coil or a curved planar coil. Use of a flat spiral coil allows for compact design that is robust and inexpensive to manufacture. Use of a helical induction coil advantageously allows for generating a homogeneous alternating electromagnetic field. As used herein a "flat spiral coil" means a coil that is generally planar coil, wherein the axis of winding of the coil is normal to the surface in which the coil lies. The flat spiral induction can have any desired shape within the plane of the coil. For example, the flat spiral coil may have a circular shape or may have a generally oblong or rectangular shape. However, the term "flat spiral coil" as used herein covers both, coils that are planar as well as flat spiral coils that are shaped to conform to a curved surface. For example, the induction coil may be a "curved" planar coil arranged at the circumference of a preferably cylindrical coil support, for example ferrite core. Furthermore, the flat spiral coil may comprise for example two layers of a four-turn flat spiral coil or a single layer of four-turn flat spiral coil.

The at least one induction coil can be held within one of a housing of the heating arrangement, or a main body or a housing of an aerosol-generating device which comprises the heating arrangement. The at least one induction coil may be wound around a preferably cylindrical coil support, for example a ferrite core.

The inductive heating arrangement may be configured to generate the alternating magnetic field continuously following activation of the system or intermittently, such as on a puff by puff basis.

The control circuit may further be configured to detect the extraction of the aerosol-generating device from a power charging unit and to automatically start generating the power pulses upon detecting the extraction of the aerosol-generating device from the power charging unit.

The control circuit may further be configured to control the overall operation of the aerosol-generating device. The control circuitry and at least parts of the inductive heating arrangement may be integral part of an overall electrical circuitry of the aerosol-generating device.

The control circuitry may comprise a microprocessor, for example a programmable microprocessor, a microcontroller, or an application specific integrated chip (ASIC) or other electronic circuitry capable of providing control. The control circuitry may comprise at least one of a transimpedance amplifier for current-to-voltage conversion, an inverting signal amplifier, a single-ended to-differential converter, an analog-digital converter and a micro-controller.

The microprocessor may be configured to at least one of: to control the switch used to generate power pulses for intermittently powering on the inductive heating arrangement, to read out the measurement device for measuring the current supplied from the DC power supply to the inductive heating arrangement, and to control the transistor switch driver circuit of the inductive heating arrangement.

The control circuitry may be or may be art of an overall controller of the aerosol-generating device.

The controller and at least a portion of the induction source, in particular the induction source apart from the inductor, may be arranged at a common printed circuit board. This proves particularly advantageous with regard to a compact design of the heating arrangement.

Preferably, the DC power supply comprises at least one battery, such as a lithium iron phosphate battery. As an alternative, the power supply may comprise another form of charge storage device such as a capacitor. The power supply may require recharging, that is, the power supply may be rechargeable. The power supply may have a capacity that allows for the storage of enough energy for one or more user experiences. For example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the induction source. The power supply may be an overall power supply of aerosol-generating device according to the present invention.

The receiving cavity may comprise an insertion opening through which an aerosol-generating article may be inserted into the receiving cavity. As used herein, the direction in which the aerosol-generating article is inserted is denoted as insertion direction. Preferably, the insertion direction corresponds to the extension of a length axis, in particular a center axis of the receiving cavity.

Upon insertion into the receiving cavity, at least a portion of the aerosol-generating article may still extend outwards through the insertion opening. The outwardly extending portion preferably is provided for interaction with a user, in particular for being taken into a user's mouth. Hence, during use of the device, the insertion opening may be close to the mouth. Accordingly, as used herein, sections close to the insertion opening or close to a user's mouth in use of the device, respectively, are denoted with the prefix "proximal". Sections which are arranged further away are denoted with the prefix "distal".

With regard to this convention, the receiving cavity may be arranged or located in a proximal portion of the aerosol-generating device. The insertion opening may be arranged or located at a proximal end of the aerosol-generating device, in particular at a proximal end of the receiving cavity.

Likewise, the receiving cavity may be formed as a cavity, in particular as an elongate cavity, which comprises a distal end portion and a proximal end portion. If present, an insertion opening may be arranged at a proximal end of the receiving cavity. At a distal end, the receiving cavity may comprise a bottom opposite to the insertion opening.

The aerosol-generating device may comprise an air path extending from at least one air inlet into the receiving cavity. That is, the aerosol-generating device may comprise at least one air inlet in fluid communication with the receiving cavity. When an aerosol-generating article is inserted into the cavity, the air path may further extend through the aerosol-forming substrate within the article and a mouthpiece of the article into a user's mouth. Preferably, the air inlet is realized at an insertion opening of the receiving cavity used for inserting the article into the cavity. Accordingly when the article is received in the cavity, air may be drawn into the receiving cavity at the rim of the insertion opening and further through an air flow passage formed between the outer circumference of the aerosol-generating article and at least one or more portions of the inner surface of the receiving cavity.

In general, the receiving cavity may have any suitable shape. In particular, the shape of the receiving cavity may correspond to the shape of the aerosol-generating article to be received therein. Preferably, the receiving cavity may have a substantially cylindrical shape or a tapered shape, for an example substantially conical or substantially frustoconical shape.

Likewise, the receiving cavity may have any suitable cross-section as seen in a plane perpendicular to a length axis of the receiving cavity or perpendicular to an insertion direction of the article. In particular, the cross-section of the receiving cavity may correspond to the shape of the aerosol-generating article to be received therein. Preferably, the receiving cavity has a substantially circular cross-section. Alternatively, the receiving cavity may have a substantially elliptical cross-section or a substantially oval cross-section or a substantially square cross-section or a substantially rectangular cross-section or a substantially triangular cross-section or a substantially polygonal cross-section. As used herein, the above mentioned shapes and cross-sections preferably refer a shape or a cross-section of the receiving cavity without considering any protrusions at the inner surface of the receiving cavity.

The inductor may be arranged such as to surround at least a portion of the receiving cavity or at least a portion of the inner surface of the receiving cavity, respectively. The inductor may be, for example a helical coil, arranged within a side wall of the receiving cavity. In particular, the inductor may be integrated in a wall defining the receiving cavity. For example, the inductor may be integrated in a wall side of the receiving cavity, in particular such as to surround at least a portion of the interior of the receiving cavity.

The receiving cavity may comprise a plurality of protrusions extending in the interior of the receiving cavity. Preferably, the protrusions are distanced from each other such that an air flow passage is formed in between neighboring protrusions, that is, by the interstices (free space) between neighboring protrusions. In addition, the plurality or protrusions may be configured to contact at least a portion of the aerosol-generating article for retention of the aerosol-generating article in the receiving cavity. The plurality of protrusions may comprise or may be formed as a rib. Preferably, the one or more ribs extend along a direction of a length axis, in particular a center axis of the receiving cavity. Preferably, the length axis of the receiving cavity corresponds to an insertion direction along which an aerosol-generating article is insertable into the receiving cavity.

The present invention further relates to an aerosol-generating system comprising an aerosol-generating device according to the invention and as described herein. The system further comprises an aerosol-generating article, wherein at least a portion of the article is removably receivable or removably received in the receiving cavity of the device. The article includes at least one aerosol-forming substrate and an inductively heatable susceptor for heating the substrate when the article is received in the cavity.

The aerosol-generating article may be a consumable, in particular intended for single use. The aerosol-generating article may be a tobacco article. In particular, the article may be a rod-shaped article, preferably a cylindrical rod-shaped article, which may resemble conventional cigarettes.

The article may comprise one or more of the following elements: a first support element, a substrate element, a second support element, a cooling element, and a filter element. Preferably, the aerosol-generating article comprises at least a first support element, a second support element and a substrate element located between the first support element and the second support element.

All of the aforementioned elements may be sequentially arranged along a length axis of the article in the above described order, wherein the first support element preferably is arranged at a distal end of the article and the filter element preferably is arranged at a proximal end of the article. Each of the aforementioned elements may be substantially cylindrical. In particular, all elements may have the same outer cross-sectional shape. In addition, the elements may be circumscribed by an outer wrapper such as to keep the elements together and to maintain the desired cross-sectional shape of the rod-shaped article. Preferably, the wrapper is made of paper.

As used herein, the term "aerosol-forming substrate" relates to a substrate capable of releasing volatile compounds that can form an aerosol when heated. The aerosol-forming substrate may be a solid or a liquid aerosol-forming substrate. The aerosol-forming substrate may comprise a tobacco-containing material containing volatile tobacco flavor compounds, which are released from the substrate upon heating. Alternatively or additionally, the aerosol-forming substrate may comprise a non-tobacco material. The aerosol-forming substrate may further comprise an aerosol former. Examples of suitable aerosol formers are glycerin and propylene glycol. The aerosol-forming substrate may also comprise other additives and ingredients, such as nicotine or flavoring substances. In particular, liquid aerosol-forming substrate may include water, solvents, ethanol, plant extracts and natural or artificial flavors. The aerosol-forming substrate may also be a paste-like material, a sachet of porous material comprising aerosol-forming substrate, or, for example, loose tobacco mixed with a gelling agent or sticky agent, which could include a common aerosol former such as glycerin, and then is compressed or molded into a plug.

The substrate element preferably comprise the at least one aerosol-forming substrate to be heated. The substrate element may further comprise the susceptor which is in thermal contact with or thermal proximity to the aerosol-forming substrate. As used herein, the term "susceptor" refers to an element comprising a material that is capable of being inductively heated within an alternating electromagnetic field. This may be the result of at least one of hysteresis losses or eddy currents induced in the susceptor, depending on the electrical and magnetic properties of the susceptor material.

The susceptor may comprise a variety of geometrical configurations. The susceptor may be one of a particulate susceptor, or a susceptor filament, or a susceptor mesh, or a susceptor wick, or a susceptor pin, or a susceptor rod, or a susceptor blade, or a susceptor strip, or a susceptor sleeve, or a susceptor cup or a cylindrical susceptor, or a planar susceptor. For example, the susceptor may be an elongated susceptor strip having a length in a range of 8 mm (millimeter) to 16 mm (millimeter), in particular, 10 mm (millimeter) to 14 mm (millimeter), preferably 12 mm (millimeter). A width of the susceptor strip may be, for example, in a range of 2 mm (millimeter) to 6 mm (millimeter), in particular, 4 mm (millimeter) to 5 mm (millimeter). A thickness of the susceptor strip preferably is in a range of 0.03 mm (millimeter) to 0.15 mm (millimeter), more preferably 0.05 mm (millimeter) to 0.09 mm (millimeter).

The susceptor may be a multi-layer susceptor, for example a multi-layer susceptor strip. In particular, the multi-layer susceptor may comprise a first susceptor material and a second susceptor material. The first susceptor material preferably is optimized with regard to heat loss and thus heating efficiency. For example, the first susceptor material may be aluminum, or a ferrous material such as a stainless steel. In contrast, the second susceptor material preferably is used as temperature marker. For this, the second susceptor material is chosen such as to have a Curie temperature corresponding to a predefined heating temperature of the susceptor assembly. At its Curie temperature, the magnetic properties of the second susceptor change from ferromagnetic to paramagnetic, accompanied by a temporary change of its electrical resistance. Thus, by monitoring a corresponding change of the electrical current absorbed by the induction source it can be detected when the second susceptor material has reached its Curie temperature and, thus, when the predefined heating temperature has been reached. The second susceptor material preferably has a Curie temperature that is below the ignition point of the aerosol-forming substrate, that is, preferably lower than 500 degrees Celsius. Suitable materials for the second susceptor material may include nickel and certain nickel alloys.

the first support element may be used to cover and protect the distal front At least one of the first support element and the second support element may comprise a central air passage. Preferably, at least one of the first support element and the second support element may comprise a hollow cellulose acetate tube. Alternatively, end of the substrate element.

The aerosol-cooling element is an element having a large surface area and a low resistance to draw, for example 15 mmWG to 20 mmWG. In use, an aerosol formed by volatile compounds released from the substrate element is drawn through the aerosol-cooling element before being transported to the proximal end of the aerosol-generating article.

The filter element preferably serves as a mouthpiece, or as part of a mouthpiece together with the aerosol-cooling element. As used herein, the term "mouthpiece" refers to a portion of the article through which the aerosol exits the aerosol-generating article.

Further features and advantages of the aerosol-generating system and the aerosol-generating article according to the present invention have already been described above with regard to aerosol-generating device and equally apply.

The present invention further relates to a method for operating an aerosol-generating device according to the present invention and as described herein. The method comprises:

operating the device in an article detection mode, by generating power pulses, in particular probe power pulses to intermittently power on the inductive heating arrangement;

measuring for each pulse at least one property of the inductive heating arrangement which is affected by the presence of the susceptor upon inserting an aerosol-generating article into the cavity of the device, and detecting whether a change of the at least one property of the inductive heating arrangement has occurred as compared to previous pulses, thus indicating the insertion of an aerosol-generating article into the cavity; and stopping operating the device in the article detection mode upon detecting a change of the at least one property of the inductive heating arrangement;

operating the device in a heating mode by activating heat operation of the inductive heating arrangement for heating the substrate.

In the article detection mode, the power pulses may be generated by using a switch. The switch may be arranged between the DC power supply and the inductive heating arrangement of the aerosol-generating device and intermittently closed and opened such as to intermittently power on the inductive heating arrangement. In contrast, in the heating mode the switch is permanently closed to continuously apply a DC voltage from the DC power supply to the inductive heating arrangement.

As mentioned above with regard to the aerosol-generating device according to the present invention, the power pulses, in particular probe power pulses may have a pre-determined pulse duration and a pre-determined time interval between two consecutive power pulses, in particular probe power pulses. The pre-determined pulse duration may be in a range between 1 microsecond and 500 microseconds, in particular between 10 microseconds and 300 microseconds, preferably between 15 microseconds and 120 microseconds, most preferably between 30 microseconds to 100 microseconds. The time interval between two consecutive power pulses, in particular probe power pulses may be in a range between 50 milliseconds and 2 seconds, in particular between 100 milliseconds and 2 seconds, preferably between 500 milliseconds and 1 second.

As mentioned above with regard to the aerosol-generating device according to the present invention, the e property preferably is at least one of an equivalent resistance of the inductive heating arrangement. The equivalent resistance may be measured via a DC current supplied from the DC power supply to the inductive heating arrangement.

Accordingly, operating the device in an article detection mode preferably comprises:

measuring for each pulse an equivalent resistance [resistive load] of the inductive heating arrangement by measuring a DC current supplied from the DC power supply to the inductive heating arrangement, and detecting whether a change of the DC current and, thus, of the equivalent resistance of the inductive heating arrangement has occurred as compared to previous pulses, thus indicating the insertion of an aerosol-generating article into the cavity; and stopping operating the device in the article detection mode upon detecting a change of the DC current and, thus, of the equivalent resistance of the inductive heating arrangement.

The article detection mode may be triggered by extracting the aerosol-generating device from a power charging unit.

Further features and advantages of the method according to the present invention have already been described above with regard to aerosol-generating device system and equally apply.

The invention is defined in the claims. However, below there is provided a non-exhaustive list of non-limiting examples. Any one or more of the features of these examples may be combined with any one or more features of another example, embodiment, or aspect described herein.

EXAMPLE EX1

An aerosol-generating device for heating an aerosol-forming substrate that is capable to form an inhalable aerosol when heated, the device comprising:

a cavity for removably receiving at least a portion of an aerosol-generating article, the article including the aerosol-forming substrate and an inductively heatable susceptor for heating the substrate;

a DC power supply;

an inductive heating arrangement connected to the DC power supply and configured to generate an alternating magnetic field within the cavity for inductively heating the susceptor of the article in a heating operation when the article is received in the cavity;

a control circuitry configured to provide power from the DC power supply to the heating arrangement for powering on the inductive heating arrangement and to detect a change of at least one property of the inductive heating arrangement due to the susceptor becoming present within or absent from within the cavity when an aerosol-generating article is inserted into or extracted from the cavity, and in response to detect at least one of the insertion of an article into the cavity or the extraction of an article from the cavity.

EXAMPLE EX2

An aerosol-generating device for heating an aerosol-forming substrate that is capable to form an inhalable aerosol when heated, the device comprising:

a cavity for removably receiving at least a portion of an aerosol-generating article, the article including the aerosol-forming substrate and an inductively heatable susceptor for heating the substrate;

a DC power supply;

an inductive heating arrangement connected to the DC power supply and configured to generate an alternating magnetic field within the cavity for inductively heating the susceptor of the article in a heating operation when the article is received in the cavity;

a control circuitry configured to generate power pulses for intermittently powering on the inductive heating arrangement and to detect a change of at least one property of the inductive heating arrangement due to the susceptor becoming present within or absent from the cavity when an aerosol-generating article is inserted into or extracted from the cavity, and in response to detect at least one of the insertion of an article into the cavity or the extraction of an article from the cavity.

EXAMPLE EX3

The aerosol-generating device according to example Ex2, wherein the control circuitry is configured to disable the heating operation of the inductive heating arrangement:

in response to detecting the extraction of an article from the cavity during a heating operation; or after a previous heating operation, and until after detecting the extraction of an article from the cavity.

EXAMPLE EX4

The aerosol-generating device according to example Ex2 or Ex3, wherein the control circuitry is configured to enable activation of the heating operation of the inductive heating arrangement:

in response to detecting the extraction of an article from the cavity during a heating operation, and after disabling the heating operation; or after a previous heating operation, and in response to detecting the extraction of an article from the cavity.

EXAMPLE EX5

The aerosol-generating device according to any of the preceding examples, wherein the control circuitry is configured to verify the insertion of an article into the cavity or the extraction of an article from the cavity by generating at least one verifying power pulse a predetermined period of time after a first detection of the change of the at least one property of the inductive heating arrangement and by re-detecting the change of at least one property of the inductive heating arrangement.

EXAMPLE EX6

The aerosol-generating article according to example Ex5, wherein the predetermined period of time is in a range between 0.5 seconds and 3 seconds.

EXAMPLE EX7

The aerosol-generating device according to any one of the preceding examples, wherein the control circuitry is configured to start heating operation of the inductive heating arrangement in response to detecting the insertion of the article into the cavity.

EXAMPLE EX8

The aerosol-generating device according to any one of the preceding examples, wherein the control circuitry further comprises a motion sensor for detecting movements of the device.

EXAMPLE EX9

The aerosol-generating article according to example Ex8, wherein the motion sensor comprises at least one of an accelerometer or a gyroscope.

EXAMPLE EX10

The aerosol-generating article according to example Ex8 or Ex9, wherein the control circuitry is configured to start generating power pulses, in particular probe power pulses, in response to detecting a movement of the device.

EXAMPLE EX11

The aerosol-generating device according to any one of examples Ex8 to Ex10, wherein the control circuitry is configured to start generating power pulses, in particular probe power pulses, in response to detecting movement of the device reaching or exceeding a pre-determined motion threshold.

EXAMPLE EX12

The aerosol-generating article according to any one of examples Ex8 to Ex11, wherein the control circuitry is configured to stop generating power pulses, in particular probe power pulses, in response to detecting for a predetermined idle time movements of the device not reaching the pre-determined motion threshold or in response to detecting for a predetermined idle time no movements.

EXAMPLE EX13

The aerosol-generating article according to any one of examples Ex8 to Ex11, wherein the control circuitry is configured to reduce a number of power pulses, in particular probe power pulses, per time unit in response to detecting for a predetermined idle time movements of the device not reaching the pre-determined motion threshold or in response to detecting for a predetermined idle time no movements.

EXAMPLE EX14

The aerosol-generating article according to example Ex12 or Ex13, wherein the idle time is in a range between 10 seconds and 90 seconds, in particular between 15 seconds and 60 seconds, preferably between 15 seconds and 40 seconds.

EXAMPLE EX15

The aerosol-generating article according to any one of examples Ex8 to Ex11, wherein the control circuitry is configured to reduce a number of power pulses, in particular probe power pulses, per time unit in response to detecting for a predetermined first idle time movements of the device not reaching the pre-determined motion threshold or in response to detecting for a predetermined first idle time no movements, and subsequently to stop generating power pulses, in particular probe power pulses, in response to detecting for a predetermined second idle time starting after the first idle time movements of the device not reaching the pre-determined motion threshold or in response to detecting for a predetermined second idle time starting after the first idle time no movements.

EXAMPLE EX16

The aerosol-generating article according to example Ex15, wherein the first idle time is in a range between 5 seconds and 60 seconds, in particular between 10 seconds and 30 seconds, preferably between 15 seconds and 25 seconds.

EXAMPLE EX17

The aerosol-generating article according to example Ex15 or Ex16, wherein the second idle time is in a range between 10 seconds and 90 seconds, in particular between 15 seconds and 60 seconds, preferably between 15 seconds and 30 seconds.

EXAMPLE EX18

The aerosol-generating device according to any one of the preceding examples, wherein the control circuit is configured to detect the extraction of the aerosol-generating device from a power charging unit.

EXAMPLE EX19

The aerosol-generating article according to example Ex18, wherein the control circuit is configured to start generating power pulses, in particular probe power pulses in response to detecting the extraction of the aerosol-generating device from the power charging unit.

EXAMPLE EX20

The aerosol-generating article according to example Ex18, wherein the control circuit is configured to start generating power pulses, in particular probe power pulses in response to detecting the extraction of the aerosol-generating device from the power charging unit for detecting the insertion of the article into the cavity.

EXAMPLE EX21

The aerosol-generating device according to any of examples according to any one of the preceding examples, wherein the control circuit is configured to detect the insertion of the aerosol-generating device into a power charging unit.

EXAMPLE EX22

The aerosol-generating article according to example Ex21, wherein the control circuit is configured to stop generating power pulses, in particular probe power pulses, in response to detecting insertion of the aerosol-generating device into a power charging unit.

EXAMPLE EX23

The aerosol-generating device according to any one of the preceding examples, wherein the control circuit is configured to stop heating operation of the device in response to at least one of detecting a pre-determined number of puffs, detecting that a predetermined heating time has elapsed, or receiving a user input.

EXAMPLE EX24

The aerosol-generating article according to any one of the preceding examples, wherein the control circuit is configured to start generating probe power pulses for detecting the extraction of the article in response to a stop of the heating operation of the device, in particular in response to detecting a stop of the heating operation of the device.

EXAMPLE EX25

The aerosol-generating device according to any one of the preceding examples, wherein the control circuitry is configured to stop heating operation of the inductive heating arrangement in response to detecting the extraction of the article from the cavity.

EXAMPLE EX26

The aerosol-generating device according to any one of the preceding examples, wherein the control circuitry comprises a switch configured and arranged to control a supply of power from the DC power supply to the inductive heating arrangement.

EXAMPLE EX27

The aerosol-generating device according to any one of the preceding examples, wherein the control circuitry comprises a measurement device for measuring a current indicative of the at least one property of the inductive heating arrangement.

EXAMPLE EX28

The aerosol-generating device according to any one of the preceding examples, wherein the power pulses, in particular the probe power pulses, have a pulse duration in a range between 1 microsecond and 500 microseconds, in particular between 10 microseconds and 300 microseconds, preferably between 15 microseconds and 120 microseconds, most preferably between 30 microseconds to 100 microseconds.

EXAMPLE EX29

The aerosol-generating device according to any one of the preceding examples, wherein a time interval between two consecutive power pulses, in particular probe power pulses, is in a range between 50 milliseconds and 2 seconds, in particular between 100 milliseconds and 2 seconds, preferably between 500 milliseconds and 1 second.

EXAMPLE EX30

The aerosol-generating device according to any one of the preceding examples, wherein the inductive heating arrangement comprises a DC/AC converter connected to the DC power supply and including an LC network, wherein the LC network comprises a series connection of a capacitor and an inductor, and wherein the inductor is configured and arranged to generate the alternating magnetic field within the cavity for inductively heating the susceptor.

EXAMPLE EX31

The aerosol-generating device according to any one of the preceding examples, wherein the at least one property is an equivalent resistance of the inductive heating arrangement or inductance of the inductive heating arrangement.

EXAMPLE EX32

The aerosol-generating device according to any one of the preceding examples, further comprising optical or haptic indication means for indicating the detection of at least one of the extraction of an article from the cavity, insertion of the article into the cavity, disablement or enablement of heating operation of the inductive heating arrangement.

EXAMPLE EX33

An aerosol-generating system comprising an aerosol-generating device according to any one of the preceding examples, and an aerosol-generating article removably receivable in the cavity of the device, wherein the aerosol-generating article comprises an aerosol-forming substrate and an inductively heatable susceptor for heating the substrate.

EXAMPLE EX34

An aerosol-generating article of an aerosol-generating system according to example Ex33 or for use with an aerosol-generating device according to any one of examples Ex1 to Ex32, wherein the aerosol-generating article comprises an aerosol-forming substrate and an inductively heatable susceptor for heating the substrate.

EXAMPLE EX35

A method of operating an aerosol-generating device for heating an aerosol-forming substrate that is capable to form an inhalable aerosol when heated, wherein the device comprises a DC power supply, a cavity for removably receiving at least a portion of an aerosol-generating article which includes the aerosol-forming substrate and an inductively heatable susceptor for heating the substrate, and an inductive heating arrangement connected to the DC power supply and configured to generate an alternating magnetic field within the cavity for inductively heating the susceptor of the article in a heating operation when the article is received in the cavity, the method comprises operating the device in an article extraction detection mode, by generating power pulses, in particular probe power pulses to intermittently power on the inductive heating arrangement;

measuring for each power pulse at least one property of the inductive heating arrangement which is affected by the susceptor becoming absent from the cavity in response to extracting an aerosol-generating article from the cavity of the device, and detecting whether a change of the at least one property of the inductive heating arrangement has occurred as compared to one or more previous power pulses, thus indicating the extraction of an aerosol-generating article into the cavity; and stopping operating the device in the article extraction detection mode in response to detecting a change of the at least one property of the inductive heating arrangement;

EXAMPLE EX36

The method according to example Ex35, further comprising:

operating the device in an article insertion detection mode, by generating power pulses, in particular probe power pulses to intermittently power on the inductive heating arrangement;

measuring for each power pulse at least one property of the inductive heating arrangement which is affected by the susceptor becoming present in the cavity in response to inserting an aerosol-generating article into the cavity of the device, and detecting whether a change of the at least one property of the inductive heating arrangement has occurred as compared to one or more previous power pulses, thus indicating the insertion of an aerosol-generating article into the cavity; and stopping operating the device in the article insertion detection mode in response to detecting a change of the at least one property of the inductive heating arrangement;

operating the device in a heating mode by activating heating operation of the inductive heating arrangement for heating the substrate.

EXAMPLE EX37

The method according to example Ex36, wherein operating the device in the article insertion detection mode and operating the device in the heating mode occur at least one of prior or after operating the device in the article extraction detection mode.

EXAMPLE EX38

The method according to any one of examples Ex35 to Ex37 wherein at least one of operating the device in an article extraction detection mode or operating the device in an article insertion detection mode comprises:

measuring for each power pulse an equivalent resistance of the inductive heating arrangement by measuring a DC current supplied from the DC power supply to the inductive heating arrangement, and detecting whether a change of the DC current and, thus, of the equivalent resistance of the inductive heating arrangement has occurred as compared to one or more previous power pulses, thus indicating the extraction of an aerosol-generating article from the cavity or the insertion of an aerosol-generating article into the cavity, respectively; and stopping operating the device in the article extraction detection mode or operating the device in the article insertion detection mode, respectively, in response to detecting a change of the DC current and, thus, of the equivalent resistance of the inductive heating arrangement.

EXAMPLE EX39

The method according to any one of example Ex35 to Ex38, wherein the power pulses, in particular the probe power pulses have a pre-determined pulse duration and a pre-determined time interval between two consecutive power pulses, in particular probe power pulses.

EXAMPLE EX40

The method according to example Ex39, wherein the pre-determined pulse duration is in a range between 1 microsecond and 500 microseconds, in particular between 10 microseconds and 300 microseconds, preferably between 15 microseconds and 120 microseconds, most preferably between 30 microseconds to 100 microseconds.

EXAMPLE EX41

The method according to any one of examples Ex39 or Ex40, wherein the time interval between two consecutive power pulses, in particular probe power pulses is in a range between 50 milliseconds and 2 seconds, in particular between 100 milliseconds and 2 seconds, preferably between 500 milliseconds and 1 second.

EXAMPLE EX42

The method according to any one of example Ex35 to Ex41, further comprising verifying the insertion of an article into the cavity or the extraction of an article from the cavity, respectively, by generating at least one verifying power pulse a pre-determined period of time after detecting the change of the at least one property of the inductive heating arrangement first and by re-detecting the change of at least one property of the inductive heating arrangement.

EXAMPLE EX43

The method according to example Ex42, wherein the pre-determined period of time is in a range between 0.5 seconds and 3 seconds.

EXAMPLE EX44

The method according to any one of examples Ex35 to Ex43, wherein the article extraction detection mode is triggered by a stop of a previous heating operation of the inductive heating arrangement.

EXAMPLE EX45

The method according to any one of examples Ex35 to Ex44, wherein operating the device in a heating mode is disabled during operating the device in an article extraction detection mode.

EXAMPLE EX46

The method according to any one of examples Ex35 to Ex45, wherein operating the device in the heating mode is enabled in response to stopping operating the device in the article extraction detection.

EXAMPLE EX47

The method according to any one of examples Ex35 to Ex46, further comprising operating the device in an idle state monitoring mode during at least one of operating the device in the article extraction detection mode or operating the device in the article insertion detection mode by:

monitoring the device for movements; and stopping operating the device in the article extraction detection mode or in the article insertion detection mode, respectively, in response to measuring no movements of the device for a predetermined idle time.

EXAMPLE EX48

The method according to any one of examples Ex35 to Ex46, further comprising operating the device in an idle state monitoring mode during at least one of operating the device in the article extraction detection mode or operating the device in the article insertion detection mode by:

monitoring the device for movements; and reducing a number of power pulses, in particular probe power pulses per time unit in response to detecting for a predetermined idle time movements of the device not reaching a pre-determined motion threshold or in response to detecting for a predetermined idle time no movements.

EXAMPLE EX49

The method according to examples Ex47 or Ex48, wherein the idle time is in a range between 10 seconds and 90 seconds, in particular between 15 seconds and 60 seconds, preferably between 15 seconds and 40 seconds.

EXAMPLE EX50

The method according to any one of examples Ex35 to Ex46, further comprising operating the device in an idle state monitoring mode during at least one of operating the device in the article extraction detection mode or operating the device in the article insertion detection mode by:

monitoring the device for movements;

reducing a number of power pulses, in particular probe power pulses per time unit in response to detecting for a predetermined first idle time movements of the device not reaching a pre-determined acceleration threshold or in response to detecting for a predetermined first idle time no movements, and subsequently stopping generating power pulses, in particular probe power pulses in response to detecting for a predetermined second idle time starting after the first idle time movements of the device not reaching the pre-determined acceleration threshold or in response to detecting for a predetermined second idle time starting after the first idle time no movements.

EXAMPLE EX51

The method according to example Ex50, wherein the first idle time is in a range between 5 seconds and 60 seconds, in particular between 10 seconds and 30 seconds, preferably between 15 seconds and 25 seconds.

EXAMPLE EX52

The method according to any one of examples Ex50 or Ex51, wherein the second idle time is in a range between 10 seconds and 90 seconds, in particular between 15 seconds and 60 seconds, preferably between 15 seconds and 30 seconds.

EXAMPLE EX53

The method according to any one of examples Ex35 to Ex52, further comprising operating the device in a stand-by mode after stopping generating power pulses, in particular probe power pulses or prior to starting generating power pulses, in particular probe power pulses in the article extraction detection mode or in the article insertion detection mode, respectively, by:

monitoring the device for movements; and starting operating the device in the article extraction detection mode or in the article insertion detection mode, respectively, in response to detecting movements of the device or movements of the device reaching or exceeding a pre-determined acceleration threshold.

EXAMPLE EX54

The method according to any one of examples Ex35 to Ex53, wherein the article insertion detection mode is triggered by extracting the aerosol-generating device from a power charging unit.

EXAMPLE EX55

An aerosol-generating device for heating an aerosol-forming substrate that is capable to form an inhalable aerosol when heated, the device comprising:

a cavity for removably receiving at least a portion of an aerosol-generating article, the article including the aerosol-forming substrate and an inductively heatable susceptor for heating the substrate;

DC power supply;

an inductive heating arrangement connected to the DC power supply and configured to generate an alternating magnetic field within the cavity for inductively heating the susceptor of the article when the article is received in the cavity;

a control circuitry configured to generate power pulses, in particular probe power pulses for intermittently powering on the inductive heating arrangement and to detect a change of at least one property of the inductive heating arrangement due to the presence of the susceptor when an aerosol-generating article is received in the cavity, thus enabling to detect the insertion of the article into the cavity.

EXAMPLE EX56

The aerosol-generating device according to example Ex55, wherein the control circuitry is further configured to activate heat operation of the inductive heating arrangement for heating the substrate upon detecting the insertion of the article into the cavity.

EXAMPLE EX57

The aerosol-generating device according to any one of examples Ex55 or Ex56, wherein the control circuitry comprises a switch configured and arranged to control a supply of power from the DC power supply to the inductive heating arrangement.

EXAMPLE EX58

The aerosol-generating device according to any one of examples Ex55 to Ex57, wherein the control circuitry comprises a measurement device for measuring a current indicative of the at least one property of the inductive heating arrangement.

EXAMPLE EX59

The aerosol-generating device according to any one of examples Ex55 to Ex58, wherein the power pulses, in particular the probe power pulses, have a pulse duration in a range between 1 microsecond and 500 microseconds, in particular between 10 microseconds and 300 microseconds, preferably between 15 microseconds and 120 microseconds, most preferably between 30 microseconds to 100 microseconds.

EXAMPLE EX60

The aerosol-generating device according to any one of examples Ex55 to Ex59, wherein a time interval between two consecutive power pulses, in particular probe power pulses is in a range between 50 milliseconds and 2 seconds, in particular between 100 milliseconds and 2 seconds, preferably between 500 milliseconds and 1 second.

EXAMPLE EX61

The aerosol-generating device according to any one of examples Ex55 to Ex60, wherein the inductive heating arrangement comprises a DC/AC inverter connected to the DC power supply and including an LC network, wherein the LC network comprises a series connection of a capacitor and an inductor, and wherein the inductor is configured and arranged to generate the alternating magnetic field within the cavity for inductively heating the susceptor.

EXAMPLE EX62

The aerosol-generating device according to any one of examples Ex55 to Ex61, wherein the at least one property is an equivalent resistance of the inductive heating arrangement or inductance of the inductive heating arrangement.

EXAMPLE EX63

An aerosol-generating system comprising an aerosol-generating device according to any one of examples Ex55 to Ex62, and an aerosol-generating article removably receivable in the cavity of the device, wherein the aerosol-generating article comprises an aerosol-forming substrate and an inductively heatable susceptor for heating the substrate.

EXAMPLE EX64

A method for operating an aerosol-generating device according to any one of examples Ex55 to Ex62, the method comprises the step of:

operating the device in an article detection mode, by
- generating power pulses, in particular the probe power pulses to intermittently power on the inductive heating arrangement;
- measuring for each pulse at least one property of the inductive heating arrangement which is affected by the presence of the susceptor upon inserting an aerosol-generating article into the cavity of the device, and detecting whether a change of the at least one property of the inductive heating arrangement has occurred as compared to previous pulses, thus indicating the insertion of an aerosol-generating article into the cavity; and
- stopping operating the device in the article detection mode upon detecting a change of the at least one property of the inductive heating arrangement;

operating the device in a heating mode by activating heat operation of the inductive heating arrangement for heating the substrate.

EXAMPLE EX65

The method according to example Ex64, wherein the step of operating the device in an article detection mode preferably comprises the step of:

measuring for each pulse an equivalent resistance of the inductive heating arrangement by measuring a DC current supplied from the DC power supply to the inductive heating arrangement, and detecting whether a change of the DC current and, thus, of the equivalent resistance of the inductive heating arrangement has occurred as compared to previous pulses, thus indicating the insertion of an aerosol-generating article into the cavity; and stopping operating the device in the article detection mode upon detecting a change of the DC current and, thus, of the equivalent resistance of the inductive heating arrangement.

EXAMPLE EX66

The method according to any one of examples Ex64 or Ex65, wherein the power pulses, in particular the probe power pulses have a pre-determined pulse duration and a pre-determined time interval between two consecutive power pulses.

EXAMPLE EX67

The method according to example Ex66, wherein the pre-determined pulse duration is in a range between 1 microsecond and 500 microseconds, in particular between 10 microseconds and 300 microseconds, preferably between 15 microseconds and 120 microseconds, most preferably between 30 microseconds to 100 microseconds.

EXAMPLE EX68

The method according to any one of examples Ex66 or Ex67, wherein the time interval between two consecutive power pulses, in particular probe power pulses is in a range between 50 milliseconds and 2 seconds, in particular between 100 milliseconds and 2 seconds, preferably between 500 milliseconds and 1 second.

EXAMPLE EX69

The method according to any one of examples Ex64 to Ex68, wherein the article detection mode is triggered by extracting the aerosol-generating device from a power charging unit.

Figure 2:
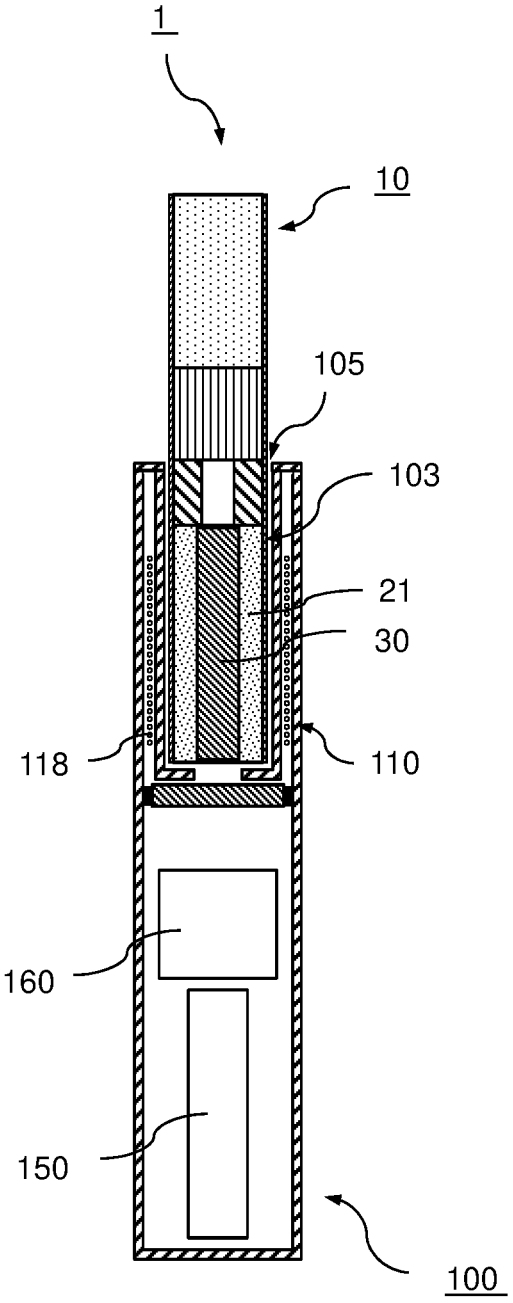
Figure 3:
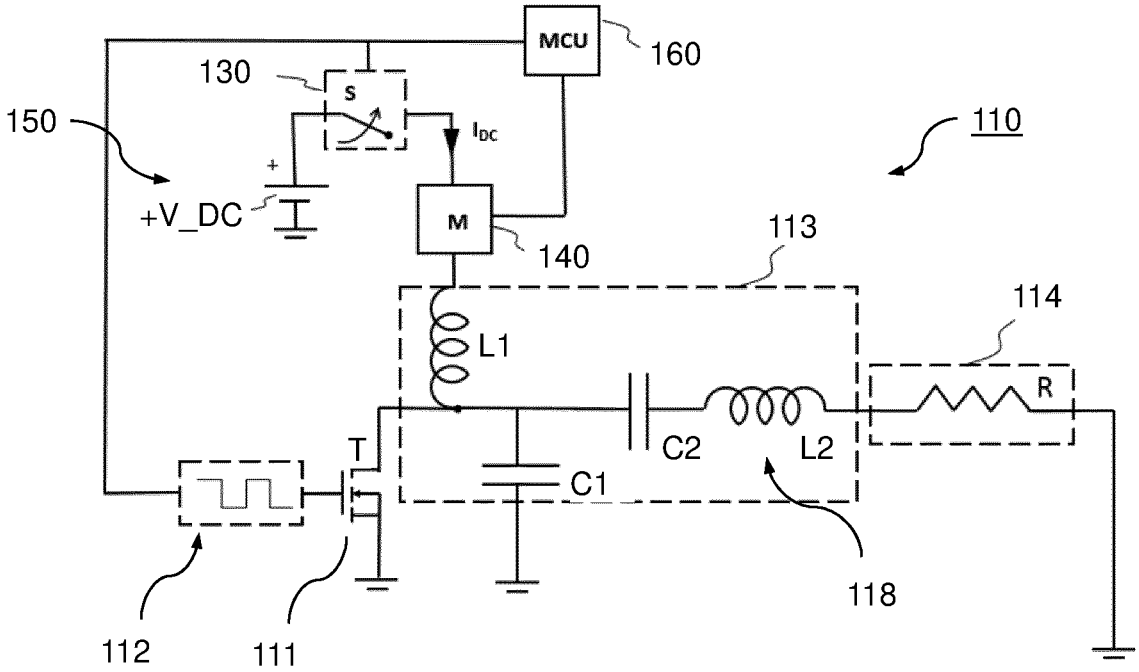
Figure 4:
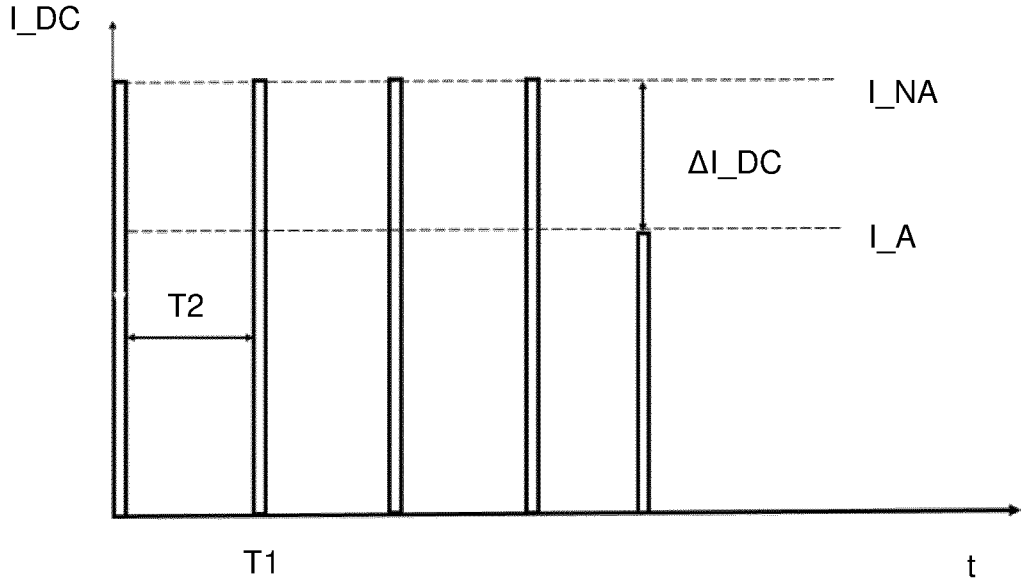
Figure 5:
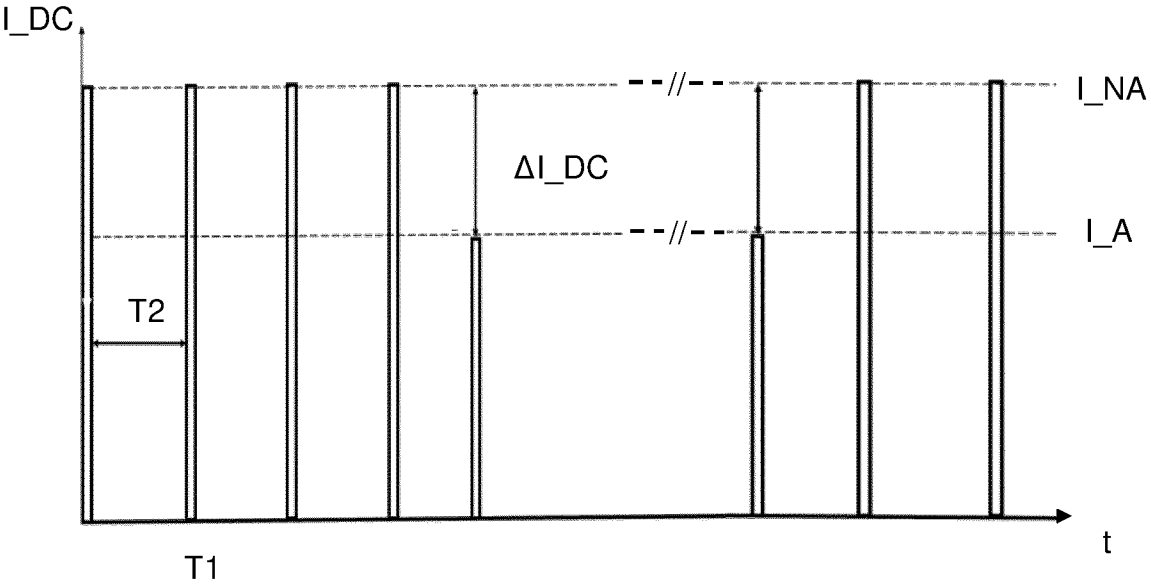
Figure 6:
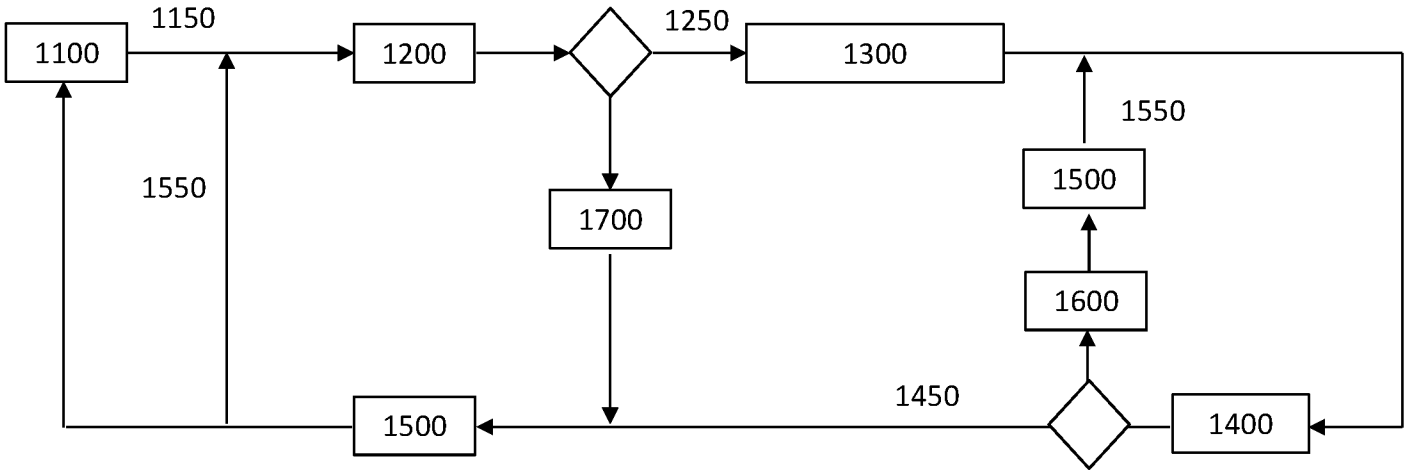

The invention will be further described, by way of example only, with reference to the accompanying drawings, in which:

FIGS. 1-2 schematically illustrate an exemplary embodiment of an aerosol-generating system according to the present invention, including an aerosol-generating device and an aerosol-generating article for use with the device;

FIG. 3 schematically illustrates the inductive heating arrangement of the aerosol-generating device according to FIGS. 1 and 2;

FIGS. 4-5 schematically illustrate operational details of the method according to the present invention; and FIG. 6 schematically illustrates different operation modes of the aerosol-generating device according to FIG. 1, in particular the different operational modes of the method according to the present invention.

FIG. 1 and FIG. 2 schematically illustrate an exemplary embodiment of an aerosol-generating system 1 according to the present invention which is used for generating an inhalable aerosol by heating an aerosol-forming substrate. The system 1 comprises an aerosol-generating article 10 which includes the aerosol-forming substrate 21 to be heated, and an aerosol-generating device 100 for heating the substrate upon engaging the article 10 with the device 100.

As can be particularly seen in FIG. 1, the aerosol-generating article 10 has a substantially rod-shape resembling the shape of a conventional cigarette. In the present embodiment, the article 10 comprises four elements sequentially arranged in coaxial alignment: a substrate element 20 arranged at a distal end of the article 10, a support element 40 with a central air passage, an aerosol-cooling element 50, and a filter element 60 arranged at a proximal end of the article 10 which serves as a mouthpiece. The substrate element 20 comprises the aerosol-forming substrate 21 to be heated as well as a susceptor 30 which is in direct physical contact with substrate 21 and used to inductively heat the substrate 21. This will be described in more detail below. The four elements have a substantially cylindrical shape with substantially the same diameter. In addition, the four elements are circumscribed by an outer wrapper 70 such as to keep the four elements together and to maintain the desired circular cross-sectional shape of the rod-like article 10. The wrapper 70 preferably is made of paper. Further details of the article 10, in particular of the four elements, are disclosed, for example, in WO 2015/176898 A1.

The elongate aerosol-generating device 100 basically has two portions: a proximal portion 102 and a distal portion 101. In the proximal portion 102, the device 100 comprises a cavity 103 for removably receiving at least a portion of the aerosol-generating article 10. In the distal portion 101, the device 100 comprises a power source 150 and a controller 160 for powering and controlling operation of the device 100. For heating substrate, the device 100 comprises an inductive heating arrangement 110 including an induction coil 118 for generating an alternating, in particular high-frequency magnetic field within the cavity 103. In the present embodiment, the induction coil 118 is a helical coil which is arranged in the proximal portion 102 of the device such as to circumferentially surround the cylindrical receiving cavity 103. The coil 118 is arranged such that the susceptor 30 of the aerosol-generating article 10 experiences the electromagnetic field upon engaging the article 10 with the device 100. The alternating magnetic field is used to inductively heat the susceptor 30 within the aerosol-generating article 10 when the article 10 is received in the cavity 103. Thus, upon inserting the article 10 into the cavity 103 of the device 100 (see FIG. 2) and activation of the heating arrangement 110, the alternating electromagnetic field within the cavity 103 induces eddy currents and/or hysteresis losses in the susceptor 30, depending on the magnetic and electric properties of the susceptor material. As a consequence, the susceptor 30 heats up until reaching a temperature sufficient to vaporize the aerosol-forming substrate 21 surrounding the susceptor 30 within the article 10. In use of the system, when a user takes a puff, that is, when a negative pressure is applied at the filter element 60 of the article 10, air is drawn into the cavity 103 at the rim of the article insertion opening 105 of the device 100. The air flow further extends towards the distal end of the cavity 103 through a passage which is formed between the inner surface of the cylindrical cavity 103 and the outer surface of the article 10. At the distal end of the cavity 103, the air flow enters the aerosol-generating article 10 through the substrate element 20 and further passes through the support element 40, the aerosol cooling element 50 and the filter element 60 where it finally exits the article 10. In the substrate element 20, vaporized material from the aerosol-forming substrate 21 is entrained into the air flow. Subsequently, when passing through the support element 40, the cooling element 50 and the filter element 60 the air flow including the vaporized material cools down such as to form an aerosol escaping the article 10 through the filter element 60.

FIG. 3 shows further details of the inductive heating arrangement 110 used to generate an alternating magnetic field within the cavity 103. According to the present embodiment, the inductive heating arrangement 110 comprises a DC/AC inverter which is connect to the DC power source 150 shown in FIGS. 1 and 2. The DC/AC inverter includes a Class-E power amplifier which in turn includes the following components: a transistor switch 111 comprising a Field Effect Transistor T (FET), for example a Metal-Oxide-Semiconductor Field Effect Transistor (MOSFET), a transistor switch supply circuit indicated by the arrow 112 for supplying the switching signal (gate-source voltage) to the transistor switch 111, and an LC load network 113 comprising a shunt capacitor C1 and a series connection of a capacitor C2 and inductor L2. The inductor L2 corresponds to the induction coil 118 shown in FIGS. 1 and 2 used to generate an alternating magnetic field within the cavity 103. In addition, there is provided a choke L1 for supplying a DC supply voltage +V_DC from to the DC power source 150. Also shown in FIG. 3 is the ohmic resistance R representing the total equivalent resistance or total resistive load 114, which—in use of the system, that is, when the article is inserted in the cavity 103 of the device 100—is the sum of the ohmic resistance of the inductor coil 118, marked as L2, and the ohmic resistance of the susceptor. Otherwise, in case no article is inserted in the cavity 103, the equivalent resistance or resistive load 114 only corresponds to the ohmic resistance of the inductor coil 118.

Further details of the inductive heating arrangement 110 according to the present embodiment, in particular with regard to its working principle, are disclosed, for example, in WO 2015/177046 A1.

For various purposes, in particular for automatically enabling or disabling the heating process and/or for preventing a user from re-heating of a depleted aerosol-generating article, it might be desirable to detect at least one of the insertion of an aerosol-generating article into the receiving cavity 103 and the extraction of an aerosol-generating article from the receiving cavity 103. For this, the aerosol-generating device according to the present embodiment may be operated in at least one of an article insertion detection mode or an article extraction detection mode.

According to the present invention, article insertion and/or extraction detection is realized via the heating arrangement 110 itself. Advantageously, this enables to avoid additional assembly space for separate sensor means. The basic idea for detecting the insertion and/or extraction of the article into or from the cavity is to detect a change of at least one property of the inductive heating arrangement due to the presence or extraction of the susceptor when an aerosol-generating article 10 is received in or extracted from the cavity 103.

In the present embodiment, it is the total resistive load 114 of the heating arrangement 110 which is used as a property of the inductive heating arrangement indicative of the presence or absence of an article 10 in the receiving cavity 103. As explained above, the value of the total equivalent resistance or total resistive load 114 depends on the presence or absence of the susceptor 30 in the vicinity of the induction coil 118. When the article is inserted in the cavity 103 of the device 100, the total equivalent resistance 118 corresponds to the sum of the ohmic resistance of the inductor coil 118 and the ohmic resistance of the susceptor 30, whereas it corresponds to the ohmic resistance of the inductor coil 118 only, when no article is received in the cavity 103.

This change of the equivalent resistance 118 may be detected via the DC current I_DC provided from the DC power source 150 to the inductive heating arrangement 110, that is, to the LC load network 113. For this, the aerosol-generating device comprises a current measurement device 140 arranged in series connection between the DC power supply 150 and the LC load network 113. Accordingly, when an aerosol-generating article 10 is inserted into the cavity 103 of the aerosol-generating device 100, the presence of the susceptor 30 increases the equivalent resistance 118 of the heating arrangement due to an increase of the resistive load 114. This in turn causes a decrease of the DC current feeding the inductive heating arrangement 110. The decrease of the DC current I_DC is detected by the current measurement device 140 which in turn may be used as a trigger signal to activate heat operation of the inductive heating arrangement 110 for heating the substrate 21.

Vice versa, when an aerosol-generating article 10 is extracted from the cavity 103, the absence of the susceptor 30 causes a decrease of the equivalent resistance 118 of the heating arrangement due to a decrease of the resistive load 114. This in turn causes an increase of the DC current feeding the inductive heating arrangement 110.

Both, the decrease as well as the increase of the DC current (ΔI_DC) may be detected by the current measurement device 140.

In order to reduce the overall power consumption when the aerosol-generating device 100 is in an article detection mode (e.g. either in an article insertion detection mode or an article extraction detection mode), the heating assembly is not operated in a continuous mode, but in a pulsed mode. For this, the aerosol-generating device 100 comprises a switch 130 that is arranged and configured to control a supply of power from the DC power supply 150 to the inductive heating arrangement 110. In the present embodiment, the switch 130 is arranged in series connection between the DC power supply 150 and the LC load network 113. During the article detection mode, the switch is intermittently opened and closed such as to generate power pulses for intermittently powering on the inductive heating arrangement 130. In contrast, during the heating mode of the aerosol-generating device 100 the switch may be permanently closed to continuously apply a DC voltage from the DC power supply to the inductive heating arrangement 110. It is also possible that the switch may be intermittently closed and opened during the heating mode of the aerosol-generating device such as to generate heating power pulses for pulsed heating of the aerosol-forming substrate. Accordingly, this mode may be denoted as pulsed heating mode.

As shown in FIG. 3, the switch 130 and the current measurement device 140 are both part of a control circuitry which also includes a microprocessor 160. The microprocessor 160 is configured to control the switch 130 used to generate power pulses for intermittently powering on the inductive heating arrangement 110, to read out the measurement device 140 for measuring the current I_DC supplied from the DC power supply to the inductive heating arrangement 110 and to control the transistor switch driver circuit 112 of the inductive heating arrangement 110. The control circuitry may be or may be art of an overall controller of the aerosol-generating device 100.

In the article insertion/extraction detection mode, the microprocessor 160 starts driving the switch 130 by closing it for a pre-determined closing time interval, thereby generating of a current pulse having a pulse duration T1 corresponding to the closing time interval. The pulse duration T1 may be in a range between 1 microsecond and 500 microseconds, in particular between 10 microseconds and 300 microseconds, preferably between 15 microseconds and 120 microseconds, most preferably between 30 microseconds to 100 microseconds. At the end of the closing time interval, the microprocessor 160 opens the switch 130 again for a predetermined opening time interval, thereby interrupting the current passage to the heating arrangement. The opening time interval corresponds to the time interval between two consecutive power pulses, which for article detection may be in a range between 50 milliseconds and 2 seconds, in particular between 100 milliseconds and 2 seconds, preferably between 500 milliseconds and 1 second. Closing and opening of the switch 130 may occur at regular time intervals such as to generate periodic power pulses for periodically powering on the inductive heating arrangement. Thus, the sum of the closing time interval and the opening time interval, or the sum of the pulse duration and the time interval between two consecutive power pulses corresponds to the periodicity of the pulse series. In general, the time interval between two consecutive probe power pulses T2 should be selected such as to balance the effect of energy depletion and user experience performance. The pulse duration T1 should be kept as minimal as possible but such to provide a reliable measurement of current pulse.

FIG. 4 is a graph showing the evolution of current pulses I_DC with time t according to an exemplary embodiment of the method of the present invention. According to this embodiment, a series of current pulses is generated with a pulse duration T1 of 100 microseconds and a time interval between two consecutive power pulses T2 of 1 second. It will be appreciated that these values are only exemplary and may change.

As long as no aerosol-generating article has been inserted, the current measuring device 140 measures for each pulse a current having a value I_NA (where the "NA" stands for "no article"). As explained, the measured value I_NA depends on the ohmic load 114, which equals the ohmic resistance of the inductor L2. In contrast, when user inserts an aerosol-generating article into the cavity 103, the ohmic load 114 is increased, since now the ohmic load equals the ohmic resistance of the inductor L2 and the ohmic resistance of the susceptor 21. Due to the increase of the ohmic load the current absorbed by heating assembly decreases. Accordingly, the current measuring device 140 measures a current pulse having a value of I_A (where the "A" stands for "article inserted") which is lower than I_NA. The difference ΔI_DC between I_NA and I_A is recorded by the microcontroller 160 which triggers the start of the heating mode.

The article insertion detection mode may be triggered, for example, by extracting the aerosol-generating device 100 from a power charging unit. For this, the aerosol-generating device may be configured to detect the extraction of the device from a power charging unit.

While FIG. 4 shows the article insertion detection mode only, FIG. 5 shows both, the evolution of current pulses I_DC during the article insertion detection mode (see left half of FIG. 5) as well as during the article extraction detection mode (see right half of FIG. 5). For the evolution of current pulses I_DC during the article insertion detection mode, reference is made to the above description of FIG. 4. The evolution of current pulses I_DC during the article extraction detection mode is reversed. That is, during the article extraction detection mode the current measuring device 140 measures for each pulse a current having a value of I_A as long as an aerosol-generating article is still received in the cavity 103. As soon as the article is extracted from the cavity, the ohmic load 114 is decreased which causes the current absorbed by the heating assembly to increase. Accordingly, the current measuring device 140 measures a current pulse having a value I_NA. The difference ΔI_DC between I_A and I_NA is also recorded by the microcontroller 160, thus indicating the extraction of the article from the cavity.

FIG. 6 shows an exemplary embedment of the method according to the present invention for operating an aerosol-generating device, in particular an aerosol-generating device 100 according to FIG. 1. In particular, FIG. 6 schematically illustrates flow diagram representing the different operational modes of the aerosol-generating device according to the present invention.

Typically, a user starts a new user experience by extracting the aerosol-generating device 100 from a power charging unit used for charging the DC power supply 150 of the device 100. This step is indicated by arrow 1150. During charging as indicated by box 1100, the device 100 is either off or in a standby mode. Advantageously, extraction 1150 of the aerosol-generating device 100 from power charging unit may be used trigger an article insertion detection mode—indicated by box 1200—for detecting the insertion of the aerosol-generating article into the cavity of the aerosol-generating device. In the article insertion detection mode 1200, a sequence of probe power pulses is generated to intermittently power on the inductive heating arrangement. At the same time, a property of the inductive heating arrangement—preferably the total resistive load of the heating arrangement—is measured for each pulse and detected whether a change of that property has occurred as compared to previous pulses, thus indicating the insertion of an aerosol-generating article into the cavity. In response to detecting such a change, the article insertion detection mode 1200 is stopped, followed by activating a heating operation of the inductive heating arrangement—as indicated by box 1300—in order to operate the device in a heating mode for heating the aerosol-forming substrate. Preferably, the detection of the insertion of an article triggers the start of the heating operation 1300, as indicate by arrow 1250. The heating operation may comprise different heating steps, such as a pre-heating step and a main heating step.

The heating operation 1300 may stop after a pre-determined number of puffs or a predetermined heating time has elapsed. Alternatively, the heating operation 1300 may be stopped manually, for example by receiving a user input from a switch.

Once the heating operation 1300 has stopped, the device is operated in an article extraction detection mode, as indicate by box 1400. Preferably, the article extraction detection mode 1400 starts in response to a stop of the heating operation 1300, in particular in response to detecting a stop of the heating operation 1300. In the article extraction detection mode 1400—like in the article insertion detection mode 1200—a sequence of probe power pulses is generated to intermittently power on the inductive heating arrangement. At the same time, a property of the inductive heating arrangement—preferably again the total resistive load of the heating arrangement—is measured for each pulse and detected whether a change of that property has occurred as compared to previous pulses, thus indicating the extraction of an aerosol-generating article from the cavity.

During the article extraction detection mode 1400, activation of a new heating operation is disabled in order to prevent a user from re-heating a depleted aerosol-generating article of a previous heating operation. As soon as the extraction of the aerosol-generating article is detected, as indicated by arrow 1450, the article extraction detection mode 1400 is stopped and activation of a new heating operation is enabled again, allowing a user to insert a new aerosol-generating article and to start the next heating operation. Accordingly, a next article insertion detection mode 1200 may be started in response to detecting the extraction of an aerosol-generating article.

In order to reduce the power consumption and, thus, to increase the overall operation time of the device addition, the device may be operated in a stand-by mode—indicated by box 1500—prior to operating the device in the (next) article insertion detection mode, in particular after the article extraction detection mode 1400 is stopped, that is, in response to detecting the extraction of an aerosol-generating article of a previous user experience. In the stand-by mode, the device is monitored for movements using a movement sensor, for example an accelerometer. In response to detecting movements of the device or movements of the device reaching or exceeding a pre-determined motion threshold, the (next) article insertion detection mode is started, as indicated by arrow 1550 in FIG. 6. Preferably, the device is continuously monitored for movements until movements of the device or movements of the device reaching or exceeding a pre-determined motion threshold are detected.

In order to reduce the power consumption, the device may be operated in an idle state monitoring mode during at least one of operating the device in the article extraction detection mode or operating the device in the article insertion detection mode. In the idle state monitoring mode, like in the stand-by mode, the device is monitored for movements using a movement sensor. In response to detecting for a predetermined idle time movements of the device not reaching a pre-determined motion threshold or even no movements, operation of the device in the article extraction detection mode or in the article insertion detection mode, respectively.

In another configuration of the idle state monitoring mode, detection is not stopped in response to detecting for a predetermined idle time movements of the device not reaching a pre-determined motion threshold or even no movements. Instead, the number of probe power pulses per time unit may be reduced, for example, by a factor of two or three.

In yet another configuration of the idle state monitoring mode,

According to another alternative configuration, the number of probe power pulses per time unit may be first reduced in response to detecting for a predetermined first idle time movements of the device not reaching a pre-determined motion threshold or even no movements. In FIG. 6, this is indicated by box 1600 for the article extraction detection mode, and by box 1700 for the article insertion detection mode. Only subsequently, the generation of probe power pulses may be stopped in response to detecting for a pre-determined second idle time starting after the first idle time movements of the device not reaching the pre-determined motion threshold or even no movements.

In any of these configurations, once the generation of probe power pulses has been stopped due to the device being in an idle state, as indicated by arrows 1650 and 1750, the device may switch into the stand-by mode 1500 in order to monitor the device for movements and subsequently—in response to detecting an appropriate movement—to (re)start operation of the device in the article extraction detection mode 1400 or in the article insertion detection mode 1200, respectively, as indicated by arrows 1550.

The stand-by mode may be stopped in response to detecting the inserting of the device into the charging unit.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±5 percent A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. An aerosol-generating device to heat an aerosol-forming substrate configured to form an inhalable aerosol when heated, the aerosol-generating device comprising:

a cavity configured to removably receive at least a portion of an aerosol-generating article, the aerosol-generating article including the aerosol-forming substrate and an inductively heatable susceptor configured to heat the aerosol-generating substrate;

a DC power supply;

an inductive heating arrangement connected to the DC power supply and configured to generate an alternating magnetic field within the cavity to inductively heat the inductively heatable susceptor in a heating operation when the aerosol-generating article is received in the cavity; and control circuitry configured to operate the device in two different modes: a heating mode, in which the aerosol-generating device carries out the heating operation, and a detection mode, in which at least one of insertion of the aerosol-generating article into the cavity or extraction of the aerosol-generating article from the cavity is detected, wherein, in the detection mode, the control circuitry is configured to:

generate power pulses for intermittently powering on the inductive heating arrangement, measure for each power pulse at least one property of the inductive heating arrangement, detect whether a change of the at least one property of the inductive heating arrangement has occurred as compared to one or more previous power pulses due to the inductively heatable susceptor becoming present within or absent from the cavity when the aerosol-generating article is inserted into or extracted from the cavity, and detect at least one of insertion of the aerosol-generating article into the cavity or extraction of the aerosol-generating article from the cavity in response to detecting of a change of the at least one property of the inductive heating arrangement.

2. The aerosol-generating device according to claim 1, wherein the control circuitry is further configured to disable the heating operation of the inductive heating arrangement:

in response to detecting the extraction of the aerosol-generating article from the cavity during a heating operation in order to stop the heating operation, or after a previous heating operation, and until after detecting the extraction of the aerosol-generating article from the cavity in order to prevent a user from re-heating a depleted aerosol-generating article of a previous heating operation.

3. The aerosol-generating device according to claim 1, wherein the control circuitry is further configured to enable activation of the heating operation of the inductive heating arrangement:

in response to detecting the extraction of the aerosol-generating article from the cavity during a heating operation, and after disabling the heating operation in order to cease disablement of the heating operation, or after a previous heating operation, and in response to detecting the extraction of the aerosol-generating article from the cavity, thus allowing a user to insert a new aerosol-generating article and to start a next heating operation.

4. The aerosol-generating device according to claim 1, wherein the control circuitry is further configured to start the heating operation of the inductive heating arrangement in response to detecting the insertion of the aerosol-generating article into the cavity.

5. The aerosol-generating device according to claim 1, wherein the control circuitry further comprises a motion sensor configured to detect movements of the aerosol-generating device.

6. The aerosol-generating device according to claim 5, wherein the control circuitry is further configured to start generating power pulses in response to detecting a movement of the aerosol-generating device.

7. The aerosol-generating device according to claim 5, wherein the control circuitry is further configured to stop generating power pulses in response to detecting for a predetermined idle time movements of the aerosol-generating device not reaching a pre-determined motion threshold or in response to detecting for a predetermined idle time no movements.

8. The aerosol-generating device according to claim 1, wherein the control circuit is further configured to detect the extraction of the aerosol-generating device from a power charging unit.

9. The aerosol-generating device according to claim 8, wherein the control circuit is further configured to start generating the power pulses in response to detecting the extraction of the aerosol-generating device from the power charging unit.

10. The aerosol-generating device according to claim 1, wherein the control circuit is further configured to detect the insertion of the aerosol-generating device into a power charging unit.

11. The aerosol-generating device according to claim 10, wherein the control circuit is further configured to stop generating the power pulses in response to detecting the insertion of the aerosol-generating device into the power charging unit.

12. The aerosol-generating device according to claim 1, wherein the control circuit is further configured to start generating power pulses for detecting the extraction of the aerosol-generating article in response to detecting a stop of the heating operation of the aerosol-generating device.

13. The aerosol-generating device according to claim 1, wherein the control circuitry is further configured to stop the heating operation of the inductive heating arrangement in response to detecting the extraction of the aerosol-generating article from the cavity.

14. The aerosol-generating device according to claim 1, wherein the control circuitry comprises a measurement device configured to measure a current indicative of the at least one property of the inductive heating arrangement.

15. An aerosol-generating system comprising an aerosol-generating device according to claim 1 and an aerosol-generating article, wherein at least a portion of the aerosol-generating article is removably receivable or removably received in the cavity of the aerosol-generating device, and wherein the aerosol-generating article comprises at least one aerosol-forming substrate and an inductively heatable susceptor configured to heat the at least one aerosol-generating substrate when the aerosol-generating article is received in the cavity.

16. The aerosol-generating device according to claim 1, wherein the detection mode and the heating mode differ from each other by at least one characteristic of the power pulses.

* * * * *